US005551956A

United States Patent [19]

Moriyama et al.

[11] Patent Number: 5,551,956

[45] Date of Patent: Sep. 3, 1996

[54] SUPERHEAVY OIL EMULSION FUEL AND METHOD FOR GENERATING DETERIORATED OIL-IN-WATER SUPERHEAVY OIL EMULSION FUEL

[75] Inventors: Noboru Moriyama, Wakayama; Tsugitoshi Ogura, Kanagawa; Akio Hiraki, Nagasaki, all of Japan

[73] Assignees: Kao Corporation; Mitsubishi Jukogyo Kabushiki Kaisha, both of Tokyo, Japan

[21] Appl. No.: 196,219

[22] PCT Filed: Jul. 27, 1993

[86] PCT No.: PCT/JP93/01056

§ 371 Date: Mar. 17, 1994

§ 102(e) Date: Mar. 17, 1994

[87] PCT Pub. No.: WO94/03560

PCT Pub. Date: Feb. 17, 1994

[30] Foreign Application Priority Data

| | | | |
|---|---|---|---|
| Aug. 5, 1992 | [JP] | Japan | 4-208991 |
| Sep. 18, 1992 | [JP] | Japan | 4-249952 |
| Sep. 18, 1992 | [JP] | Japan | 4-249953 |

[51] Int. Cl.$^6$ ..... C10L 1/10

[52] U.S. Cl. ..... 44/301

[58] Field of Search ..... 44/301; 252/354, 252/356, 357, 311.5

[56] References Cited

U.S. PATENT DOCUMENTS

| | | | |
|---|---|---|---|
| 3,740,344 | 6/1973 | Ferm | 252/311.5 |
| 3,867,162 | 2/1975 | Elste, Jr. | 252/311.5 |
| 4,560,482 | 12/1985 | Canevari | 210/749 |
| 4,793,826 | 12/1988 | Hayes | 44/301 |
| 5,024,676 | 6/1991 | Moriyama et al. | 44/301 |

FOREIGN PATENT DOCUMENTS

| | | | |
|---|---|---|---|
| 0472329 | 2/1992 | European Pat. Off. | 44/301 |
| 1313592 | 12/1989 | Japan . | |
| 1313595 | 12/1989 | Japan | 44/301 |
| 397788 | 4/1991 | Japan . | |
| 3097788 | 4/1991 | Japan | 44/301 |
| 3097785 | 4/1991 | Japan | 44/301 |
| 3097787 | 4/1991 | Japan | 44/301 |
| 2220673 | 1/1990 | United Kingdom | 44/301 |

*Primary Examiner*—Margaret B. Medley

*Attorney, Agent, or Firm*—Birch, Stewart, Kolasch & Birch, LLP

[57] ABSTRACT

A superheavy oil emulsion fuel having a low viscosity and a good long-term stability, which comprises, in a mixed and emulsified state, 100 parts by weight of a superheavy oil, 25 to 80 parts by weight of water and 0.02 to 5 parts by weight of a specific nonionic surfactant.

A method for regenerating an oil-in-water superheavy oil emulsion fuel deteriorated to such a slight extent that the emulsion fuel can be pumped and handled as a fluid liquid to give an oil-in-water superheavy oil emulsion fuel having a good fluidity and a low unburned content, and a method for regenerating an oil-in-water superheavy oil emulsion fuel deteriorated to such a remarkable extent that the emulsion fuel has such a high viscosity that the pumping thereof is difficult and cannot be handled as a fluid liquid to give an oil-in-water superheavy oil emulsion fuel having a good fluidity and a low unburned content, wherein use is made of a specific nonionic surfactant.

12 Claims, 1 Drawing Sheet

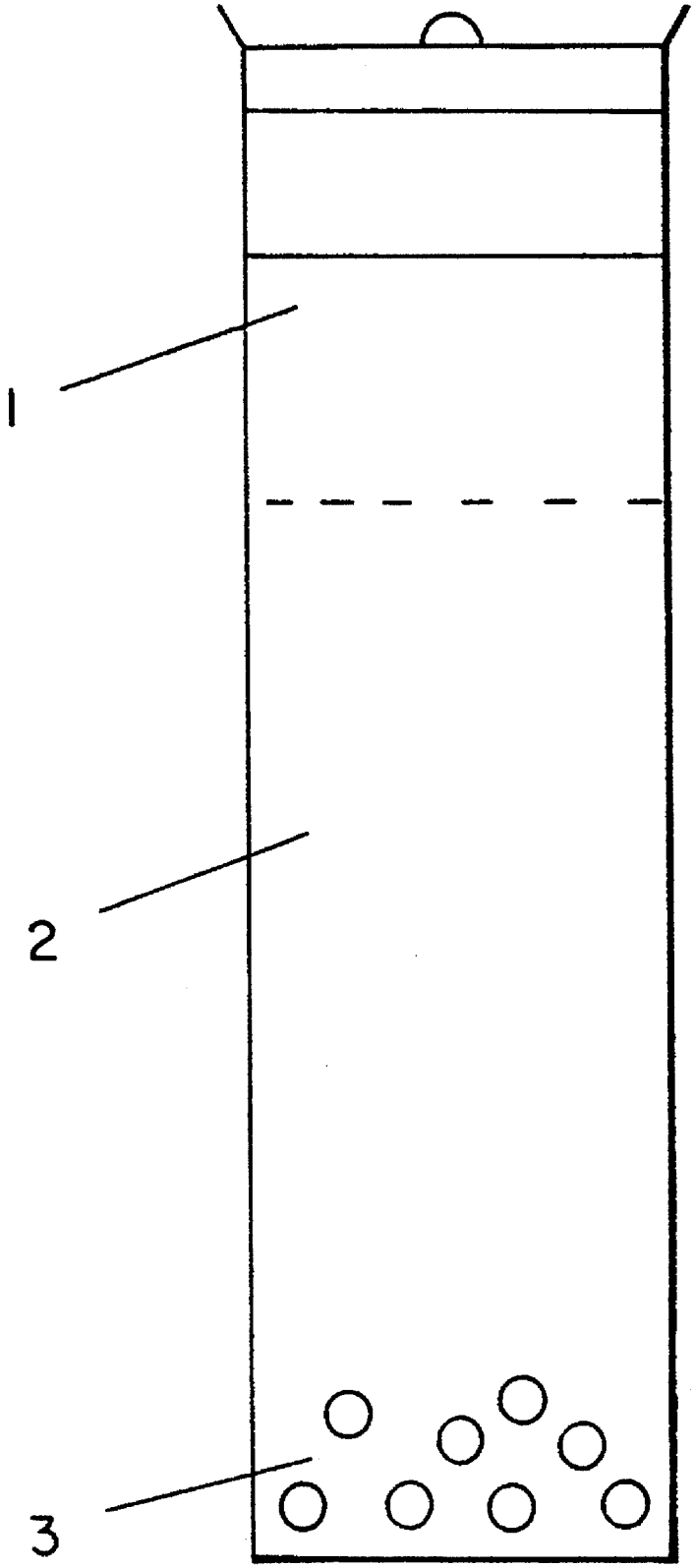
1
2
3

SUPERHEAVY OIL EMULSION FUEL AND METHOD FOR GENERATING DETERIORATED OIL-IN-WATER SUPERHEAVY OIL EMULSION FUEL

BACKGROUND OF THE INVENTION

1. Field of the Invention

The present invention relates to a superheavy oil emulsion fuel.

Further, the present invention relates to a method for regenerating a deteriorated oil-in-water (hereinafter abbreviated to O/W) superheavy oil emulsion fuel.

2. Description of the Related Art

Oil sand, bitumens (e.g. Orinoco tar and Athabasca bitumen), and so forth have attracted special attention as fossil fuel resources which do not fall under the category of petroleum, coal and LNG by virtue of their high reserve. Among the fossil fuel resources under the category of petroleum as well, asphalt obtained by removing the distillates, such as naphtha, from petroleum or residues obtained by heat-treating the asphalt are in surplus. These superheavy oils are usually an oleaginous material containing about 60 to 70% or, in some cases, 70% or more of a heavy fraction having a boiling point of 420° to 450° C. or, in some cases, 450° C. or above, which is a vacuum distillation residue, and, as such, do not flow or have a viscosity as high as tens of thousands of centipoises or more. For this reason, if the use thereof as a fuel is intended without heating them to a temperature as high as 280° to 300° C., there occur not only problems in handling, atomization, etc., but also troubles of clogging of piping, etc., which renders them very difficult to use.

In recent years, an attempt has been made tog bring the viscosity of the superheavy oils difficult to handle close to that of water through emulsification of the superheavy oil in water. Namely, a proposal has hitherto been made with respect to an oil-in-water type (O/W type) emulsion fuel of a superheavy oil produced by emulsifying a superheavy oil (O) in water (W) with the use of a surfactant [see, for example, U.S. Pat. Nos. 5,024,676 (Assignees; Kao Corp. and Mitsubishi Jukogyo kabushiki Kaisha, Published on Jun. 18, 1991) and 4,923,483 (Assignee; Intevep, S. A., Published on May 8, 1990), and Japanese Patent Publication-A Nos. 313592/1989 (Published on Dec. 19, 1989) and 97788/1991 (Published on Apr. 23, 1991)]. The emulsion fuel has a viscosity relatively close to that of water and can sufficiently be atomized in a temperature range from ordinary temperature to 90° C., and therefore is a fuel having a very good handleability. In the O/W type emulsion fuel, the lower the content of W (water), that is, the higher the content of O (oil), the better the quality of the fuel and the lower the fuel loss.

In order to handle the emulsion fuel in the same manner as that of conventional liquid fuel oils, it is necessary that the emulsion fuel has long-term stability, sufficient to withstand transportation and storage, and it is known that a surfactant plays an important role in maintaining the emulsion fuel emulsified in water in a stable state for a long period of time. However, in emulsion fuel produced by emulsifying a superheavy oil which has a very high heavy-fraction content, and which does not flow or has a viscosity as high as tens of thousands of centipoises or more, a further improvement in the long-term stability has been desired in the art.

In addition, to use the emulsion fuel effectively, regeneration of a deteriorated superheavy oil emulsion fuel may also be advantageous (see, for example, G.B. Patent No. 2220673, Published on Jan. 2nd, 1992). An emulsion system is a thermodynamically unstable one which breaks down with a lapse of time. In the above-described superheavy emulsion fuel as well, the emulsion partly breaks, i.e., deteriorates, during storage over a long period of time, including transportation by ship. When this deteriorated emulsion is burned as such, an unfavorable phenomena in the combustion, such as a high unburned content, frequently occurs. Further, the progress of the deterioration lowers the fluidity of the emulsion which increases the viscosity to such an extent that the emulsion cannot be handled as a fluid liquid, which renders the pumping thereof difficult. Therefore, what is important is to modify the deteriorated superheavy oil emulsion fuel into a fuel having a good fluidity and a low unburned content, i.e., to regenerate the deteriorated superheavy oil emulsion fuel prior to combustion.

DISCLOSURE OF THE INVENTION

Summary of the Invention

The present inventors have made various studies. As a result, they have found that an O/W type superheavy oil emulsion having a low viscosity and a good long-term stability can be obtained with the use of a specified nonionic surfactant, and optionally a specified anionic, cationic or amphoteric surfactant, as the surfactant. Further, they have found that the use of a specified nonionic surfactant as the surfactant enables a deteriorated O/W superheavy oil emulsion fuel to be regenerated.

Thus, the present invention relates to a superheavy oil emulsion fuel comprising or consisting essentially of, in a mixed and emulsified state, 100 parts by weight of a superheavy oil, 25 to 80 parts by weight of water and 0.02 to 5 parts by weight of a nonionic surfactant selected from the group consisting of (i) an adduct of a tall oil fatty acid, a tall rosin, a gum rosin, a wood rosin or a mixture thereof with an alkylene oxide, (ii) a mono- or/and diester of a tall oil fatty acid, a tall rosin, a gum rosin, a wood rosin or a mixture thereof with an alkylene oxide polymer, (iii) an adduct of an aromatic ring compound having in its molecule one or more carboxyl groups and derived from petroleum or coal with an alkylene oxide and (iv) a mono- or/and diester of an aromatic ring compound having in its molecule one or more carboxyl groups and derived from petroleum or coal with an alkylene oxide polymer.

Nonionic surfactants (i) to (iv) may contain an additional alkylene oxide polymer. That is, nonionic surfactant (v) which contains an alkylene oxide polymer in addition to nonionic surfactant (i) may substitute for nonionic surfactant (i), nonionic surfactant (vi) which contains an alkylene oxide polymer in addition to nonionic surfactant (ii) may substitute for nonionic surfactant (ii), nonionic surfactant (vii) which contains an alkylene oxide polymer in addition to nonionic surfactant (iii) may substitute for nonionic surfactant (iii), and nonionic surfactant (viii) which contains an alkylene oxide polymer in addition to nonionic surfactant (iv) may substitute for nonionic surfactant (iv).

The above-described superheavy oil emulsion fuels preferably further contain, based on 100 parts by weight of the nonionic surfactant, 0.5 to 800 parts by weight of an anionic surfactant; or 0.5 to 300 parts by weight of a surfactant selected from the group consisting of the following cationic surfactants (I), (II), (IV), (VI) and (VII) and amphoteric surfactants (III), (V), (VIII) and (IX):

carbonic surfactant (I)

an alkyl- or alkenylamine salt produced by neutralizing an alkyl- or alkenylamine having 4 to 18 carbon atoms with an inorganic or organic acid;

cationic surfactant (II)

a quaternary ammonium salt represented by the following formulae (1), (2) or (3):

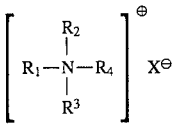

(1)

wherein $R_1$, $R_2$, $R_3$ and $R_4$ represent each an alkyl or alkenyl group having 1 to 18 carbon atoms and $X^{\theta}$ represents a counter anion, e.g., chlorine ion and bromine ion,

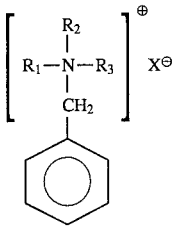

(2)

wherein $R_1$, $R_2$, $R_3$ and $X^{\theta}$ are as defined above, and

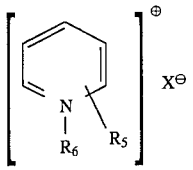

(3)

wherein $R_5$ represents an alkyl or alkenyl group having 8 to 18 carbon atoms, $R_6$ represents a hydrogen atom or a methyl group and $X^{\theta}$ is as defined above;

amphoteric surfactant (III)

an alkyl- or alkenylbetaine represented by the following formula:

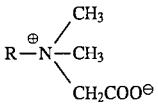

wherein R represents an alkyl or alkenyl group having 8 to 18 carbon atoms;

cationic surfactant (IV)

an alkyl- or alkenylamine oxide represented by the following formula:

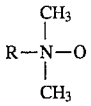

wherein R is as defined above;

amphoteric surfactant (V)

an alkyl- or alkenylalanine represented by the following formula:

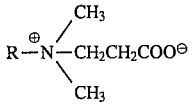

wherein R is as defined above;

cationic surfactant (VI)

a polyamiet represented by the following formulae (4) or (5):

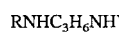

(4)

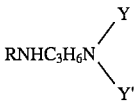

(5)

wherein R is as defined above and Y and Y' represent each an oxyethylene chain represented by the formula $-(C_2H_4O-)_mH$ wherein m is 1 to 50;

cationic surfactant (VII)

a polyamine salt represented by the following formula (6):

(6)

wherein R is as defined above and X' represents an inorganic or organic acid, e.g., hydrochloric acid and acetic acid;

amphoteric surfactant (VIII)

an amphoteric imidazoline surfactant represented by the following formula:

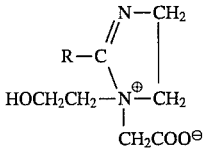

wherein R is as defined above; and amphoteric surfactant (IX)

an amphoteric sulfobetaine surfactant represented by the following formula:

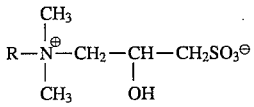

wherein R is as defined above.

In addition, the above-described superheavy oil emulsion fuels preferably further contain 0.01 to 1% by weight of a hydrophilic polymer.

It is preferred to use efficient mechanical means in the production of these compositions, that is, these superheavy oil emulsion fuels.

The present invention further relates to a method for regenerating a deteriorated O/W superheavy oil emulsion fuel, which comprises or consists essentially of adding 0.01 to 2 parts by weight of a nonionic surfactant selected from the group consisting of the above-described nonionic surfactants (i), (ii), (iii) and (iv) or the above-described nonionic surfactants (v), (vi), (vii) and (viii) to 100 parts by weight of an O/W superheavy oil emulsion fuel deteriorated to such a slight extent that the emulsion fuel can be pumped and handled as a fluid liquid, and then subjecting the mixture to high-shear agitation.

The present invention also relates to a method for regenerating a deteriorated O/W superheavy oil emulsion fuel, which comprises or consists essentially of adding both an anionic surfactant selected from the group consisting of the following anionic surfactants (XI), (XII), (XIII), (XIV), (XV), (XVI) and (XVII) and a nonionic surfactant selected from the group consisting of the above-described nonionic surfactants (i), (ii), (iii) and (iv) or the above-described nonionic surfactants (v), (vi), (vii) and (viii) to an O/W superheavy oil emulsion fuel deteriorated to such a remarkable extent that the emulsion fuel has such a high viscosity that the pumping thereof is difficult and it cannot be handled as a fluid liquid in such a proportion that the weight ratio of the anionic surfactant to the nonionic surfactant is in the range of from 10/1 to 1/10 and the total amount of the anionic surfactant and the nonionic surfactant is 0.01 to 3 parts by weight based on 100 parts by weight of the deteriorated O/W emulsion fuel, and then agitating the resultant mixture:

anionic surfactant (XI)

a sulfonic acid of an aromatic ring compound such as naphthalene, alkylnaphthalene, alkylphenol and alkylbenzene or a salt thereof, or a formalin (formaldehyde) condensate of a sulfonic acid of an aromatic ring compound or a salt thereof, wherein the average degree of condensation of formalin is 1.2 to 100 and the salt is an ammonium salt, a lower amine salt such as a monoethanolamine, diethanolamine, triethanolamine or triethylamine salt, or an alkali metal or alkaline earth metal salt such as a sodium, potassium, magnesium or calcium salt;

anionic surfactant (XII)

ligninsulfonic acid, a salt thereof or a derivative thereof, or a formalin (formaldehyde) condensate of ligninsulfonic acid and a sulfonic acid of an aromatic compound such as naphthalene or alkylnaphthalene, or a salt thereof, wherein the salt is an ammonium salt, a lower amine salt such as a monoethanolamine, diethanolamine, triethanolamine or triethylamine salt, or an alkali metal or alkaline earth metal salt such as a sodium, potassium, calcium or magnesium salt and the average degree of condensation of formalin is 1.2 to 50;

anionic surfactant (XIII)

polystyrenesulfonic acid or a salt thereof, or a copolymer of styrenesulfonic acid With other comonomer(s) or a salt thereof, wherein the molecular weight is 500 to 500,000 and the salt is an ammonium salt, a lower amine salt such as a monoethanolamine, diethanolamine, triethanolamine or triethylamine salt, or an alkali metal or alkaline earth metal salt such as a sodium, potassium, calcium or magnesium salt;

anionic surfactant a polymer of dicyclopentadienesulfonic acid or a salt thereof, wherein the molecular weight is 500 to 500,000 and the salt is an ammonium salt, a lower amine salt such as a monoethanolamine, diethanolamine, triethanolamine or triethylamine salt, or an alkali metal or alkaline earth metal salt such as a sodium, potassium, calcium or magnesium salt;

anionic surfactant (XV)

a copolymer of maleic anhydride or/and itaconic anhydride with other comonomer(s), or a salt thereof, wherein the molecular weight is 500 to 500,000, and the salt is an ammonium salt or an alkali metal salt such as a sodium or potassium salt;

anionic surfactant (XVI)

a maleinized liquid polybutadiene or a salt thereof, wherein the molecular weight of the liquid polybutadiene as the starting material is 500 to 200,000, and the salt is an ammonium salt or an alkali metal salt such as a sodium or potassium salt; and anionic surfactant (XVII)

an anionic surfactant having in its molecule one or two hydrophilic groups and selected from the group consisting of the followings (a) to (h).

(a) a sulfuric ester salt of an alcohol having 4 to 18 carbon atoms, wherein the salt is an ammonium salt, a lower amine salt such as a monoethanolamine, diethanolamine, triethanolamine or triethylamine salt, or an alkali metal or alkaline earth metal salt such as a sodium, potassium, magnesium or calcium salt;

(b) An $C_{4-18}$ alkane-, alkene- or alkylarylsulfonic acid or a salt thereof, wherein the salt is an ammonium salt, a lower amine salt such as a monoethanolamine, diethanolamine, triethanolamine or triethylamine salt, or an alkali metal or alkaline earth metal salt such as a sodium, potassium, magnesium or calcium salt;

(c) a sulfate or phosphate of an adduct of a compound having in its molecule at least one active hydrogen with an alkylene oxide or a salt thereof, wherein the salt is an ammonium, sodium, potassium, magnesium or calcium salt;

(d) a sulfosuccinic acid ester salt of a saturated or unsaturated alcohol having 4 to 22 carbon atoms, wherein the salt is an ammonium, sodium or potassium salt;

(e) an alkyldiphenyletherdisulfonic acid or a salt thereof, wherein the alkyl group has 8 to 18 carbon atoms, and the salt is an ammonium, sodium, potassium, magnesium or calcium salt;

(f) a rosin or a salt thereof, wherein the salt is an ammonium, sodium or potassium salt, which includes, for example, a mixed tall acid comprising a tall rosin and a tall oil fatty acid, i.e., a higher fatty acid, a tall rosin, a gum rosin, a wood rosin and salts thereof;

(g) an $C_{4-18}$ alkane or alkene fatty acid or a salt thereof, wherein the salt is an ammonium, potassium or sodium salt; and (h) an α-sulfofatty acid ester salt represented by the following general formula:

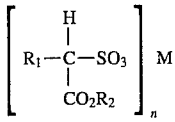

wherein $R_1$ represents an alkyl- or alkenylgroup having 6 to 22 carbon atoms, $R_2$ represents an alkyl group having 1 to 22 carbon atoms, M represents an alkali metal ion, an alkaline earth metal ion, an ammonium ion or an organic amine, and n is 1 or 2.

Further scope and the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Now, the superheavy oil emulsion fuel according to the present invention will be described in detail.

The oil called "superheavy oil" in the present invention includes the following oils which do not flow unless they are heated to high temperature.

(1) Petroleum-derived asphalt and a mixture containing the asphalt.

(2) Products, intermediate products and residues of various treatments of petroleum-derived asphalt, and mixtures containing one or more of them.

(3) High fluid point oils or crude oils which do not flow even at high temperature.

(4) Petroleum-derived tar pitch and a mixture containing the tar pitch.

(5) Bitumen (such as Orinoco tar and Athabasca bitumen).

It is generally believed that naphthenic asphalt can be easily emulsified while asphalt derived from a paraffin base oil or a mixed base oil is difficult to emulsify. In the case of the naphthenic asphalt as well, the difficulty arises in emulsifying the asphalt having a high heavy-fraction content prepared by sufficiently distilling volatile components. In recent years, the asphalt, in many cases, is prepared by removing volatile components sufficiently by distillation. The asphalt contemplated in the present invention is mainly one from which an emulsion having excellent long-term stability has difficulty produced in the prior art.

The superheavy oil is limited to one with a volatile content of 12% by weight or less at 340° C. Therefore, the molecular weight is larger than that of the components constituting ordinary oils, and examples thereof include asphaltene (MW 1500 to 2500), resin component (aromatics) and oil matters. More specific examples thereof include compounds containing in its molecule the following polycyclic aromatic ring which may have an alkyl chain:

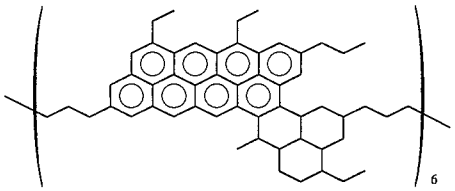

asphaltene

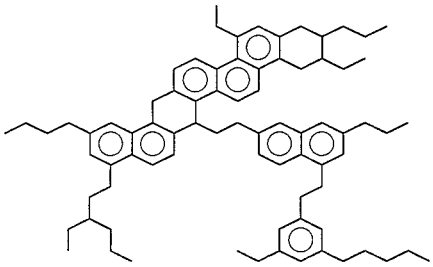

polar aromatic component

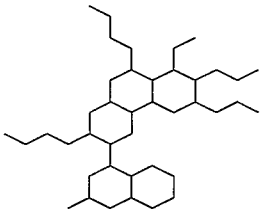

saturated component

Water to be used in the present invention is city water or a deionized water.

Next, the nonionic surfactants to be used in the present invention will be described in more detail.

(i) an adduct of a tall oil fatty acid, a tall rosin, a gum rosin, a wood rosin or a mixture thereof with an alkylene oxide;

(ii) a mono- or/and diester of a tall oil fatty acid, a tall rosin, a gum rosin, a wood rosin or a mixture thereof with an alkylene oxide polymer;

(v) a mixture of an adduct of a tall oil fatty acid, a tall rosin, a gum rosin, a wood rosin or a mixture thereof with an alkylene oxide, and an alkylene oxide polymer; and (vi) a mixture of a mono- or/and diester of a tall oil fatty acid, a tall rosin, a gum rosin, a wood rosin or a mixture thereof with an alkylene oxide polymer, and an alkylene oxide polymer.

The tall rosin in the above description may be called as "tall rosin acid" or "tall resin acid" in the art.

Tall oil fatty acids and tall rosins obtained from plant resources such as raw wood can be produced, for example, by the following process. Chips are prepared from the raw wood, etc., on a chipper and cooked in a digester containing NaOH or $Na_2S$, and pulp is removed by filtration. After the pulp-free filtrate is stored, the separated black liquor is removed and sulfuric acid is added to the remaining solution. The formed Glauber's salt solution, that is the formed aqueous solution of $Na_2SO_4 \cdot 10H_2O$, is removed, and the remaining solution is washed with warm water and dehydrated in a centrifuge to provide a crude tall oil. After the pitch is removed, the residue is subjected to topping to provide a crude tall oil fatty acid, while a tall rosin is obtained from the distillation residue.

Rosins include, besides tall rosin, a gum rosin produced by directly cutting a pine tree to harvest a crude pine resin, removing turpentine oil from the raw pine resin to provide a gum rosin; and a wood rosin produced by chipping a pine root, extracting a rosin component from the chip with a solvent and removing the solvent by distillation to provide a wood rosin. Representative resin acid compositions of these three rosins are as given in Table 1.

TABLE 1

| | Representative resin acid composition (%) of each rosin | | | | | |
|---|---|---|---|---|---|---|
| | Compsn. | | | | | |
| Name | abietic acid | neoabietic acid | dehydroabietic acid | pimaric acid | isopimaric acid | palustric acid |
| hartall rosin | 30~45 | 2~5 | 15~25 | 3~8 | 4~10 | 10~15 |
| gum rosin | 20~40 | 15~25 | 3~8 | 3~8 | 10~20 | 20~30 |
| wood rosin | 35~45 | 2~10 | 10~15 | 5~8 | 10~15 | 10~20 |

The nonionic surfactants (i), (ii), (v) and (vi) according to the present invention are produced by adding an alkylene oxide to a starting material, e.g., the above crude tall oil fatty acid, refined tall oil fatty acid, a rosin and a mixture of two or more of them, or esterifying the starting material with a polymer of an alkylene oxide. The nonionic surfactants (i), (ii), (v) and (vi) may contain also a starting material which reacted with no alkylene oxide or no alkylene oxide polymer.

In the addition products, a polymer of an alkylene oxide as by-product may also be contained. Therefore, an addition product which does not contain an additional polymer of an alkylene oxide in admixture is called as nonionic surfactant (i) and, on the other hand, an addition product which additionally contains a polymer of an alkylene oxide in admixture is called as nonionic surfactant (v) in the present invention. In the esterification products, a diester and a polymer of an alkylene oxide as by-product may also be contained. Therefore, an esterification product which does not contain an additional polymer of an alkylene oxide in admixture is called as nonionic surfactant (ii) and, on the other hand, an esterification product which additionally contains a polymer of an alkylene oxide in admixture is called as nonionic surfactant (vi) in the present invention.

The alkylene oxide to be added is ethylene oxide, propylene oxide, butylene oxide or styrene oxide. Although the number of moles of addition (average value) is not particularly limited, it should be regulated in such a manner that the HLB falls within a favorable range. The HLB (hydrophile-lipophile balance) of these nonionic surfactants is preferably 11 to 19, and still more preferably 14 to 19.

(iii) an adduct of an aromatic ring compound having in its molecule one or more carboxyl groups and derived from petroleum or coal with an alkylene oxide;

(iv) a mono- or/and diester of an aromatic ring compound having in its molecule one or more carboxyl groups and derived from petroleum or coal with an alkylene oxide polymer;

(vii) a mixture of an adduct of an aromatic ring compound having in its molecule one or more carboxyl groups and derived from petroleum or coal with an alkylene oxide, and an alkylene oxide polymer; and (viii) a mixture of a mono- or/and diester of an aromatic ring compound having in its molecule one or more carboxyl groups and derived from petroleum or coal with an alkylene oxide polymer, and an alkylene oxide polymer.

The aromatic ring compound having in its molecule one or more carboxyl groups and derived from petroleum or coal refers to every compounds containing at least one carboxyl group obtained by distillation, decomposition, etc., of petroleum or coal. Examples thereof include compounds comprising a benzene ring, a naphthalene ring, an anthracene ring or other ring each having at least one carboxyl group and optionally further an alkyl group, an aromatic ring or a functional group.

The nonionic surfactants (iii), (iv), (vii) and (viii) according to the present invention is produced by adding an alkylene oxide to the above aromatic ring compound having in its molecule a carboxyl group as a starting material or esterifying the starting material with a polymer of an alkylene oxide. The nonionic surfactants (iii), (iv), (vii) and (viii) may contain also a starting material which reacted with no alkylene oxide or no alkylene oxide polymer.

In the addition products, a polymer off an alkylene oxide as by-product may also be contained. Therefore, an addition product which does not contain an additional polymer of an alkylene oxide in admixture is called as nonionic surfactant (iii) and, on the other hand, an addition product which additionally contains a polymer of an alkylene oxide in admixture is called as nonionic surfactant (vii) in the present invention. In the esterification products, a diester and a polymer of an alkylene oxide may also be contained. Therefore, an esterification product which does not contain an additional polymer of an alkylene oxide is called as nonionic surfactant (iv) and, on the other hand, an esterification product which additionally contains a polymer of an alkylene oxide in admixture is called as nonionic surfactant (viii) in the present invention.

The alkylene oxide to be added comprises at least one of ethylene oxide, propylene oxide, butylene oxide and styrene oxide. The HLB value of these nonionic surfactant is preferably 11 to 19, and still more preferably 14 to 19.

As described above, the superheavy oil to be used in the present invention usually has in its molecule a polycyclic aromatic ring which may have an alkyl group. Therefore, nonionic surfactants having a polycyclic aromatic ring which may have an alkyl group have a good affinity to the superheavy oil and exhibit an excellent performance as an emulsifier because they are similar to the superheavy oil in structure.

The superheavy oil emulsion fuel according to the present invention comprises 100 parts by weight of the superheavy oil, 25 to 80 parts by weight of water and 0.02 to 5 parts by weight of the nonionic surfactant. When this requirement is satisfied, a superheavy oil emulsion fuel having a long-term stability and low viscosity can be provided.

In practicing the present invention, the use of the nonionic surfactant described above in the form of a mixture thereof with a surfactant selected from the group consisting of an anionic surfactant, a cationic surfactant and an amphoteric surfactant can contribute to a further improvement in the stability.

A preferable embodiment of the present invention is a superheavy oil emulsion fuel comprising a superheavy oil, water, a nonionic surfactant and an anionic surfactant.

The anionic surfactant which is contained in the superheavy oil emulsion fuel according to the present invention is not limited. Preferred examples thereof include the following anionic surfactants (XI) to (XVII).

Anionic surfactant (XI)

This category includes a sulfonic acid of an aromatic ring compound such as naphthalene, alkylnaphthalene, alkylphenol and alkylbenzene or a salt thereof, and a formalin (formaldehyde) condensate of a sulfonic acid of an aromatic ring compound or a salt thereof.

The average degree of condensation of formalin (formaldehyde) is 1.2 to 100, preferably 2 to 20. The salt is an ammonium salt, a lower amine salt such as a monoethanolamine, diethanolamine, triethanolamine or triethylamine, or an alkali metal or an alkaline earth metal salt such as a sodium, potassium, magnesium or calcium salt.

Antonio surfactant (XII)

This category includes ligninsulfonic acid, a salt thereof or a derivative thereof, and a formalin (formaldehyde) condensate of ligninsulfonic acid and a sulfonic acid of an aromatic compound such as naphthalene or alkylnaphthalene, or a salt thereof.

In any case, the salt is an ammonium salt, a lower amine salt such as a monoethanolmine, diethanolamine, triethanoamine or triethylamine salt, or an alkali metal or an alkaline earth metal salt such as sodium, potassium, calcium or magnesium. The average degree of condensation of formalin (formaldehyde) is 1.2 to 50, preferably 2 to 20.

Among lignins, a modified lignin, for example, a lignin having some carboxyl groups exhibits an excellent performance particularly at high temperature.

Anionic surfactant (XIII)

This category includes polystyrenesulfonic acid or a salt thereof, and a copolymer of styrenesulfonic acid with other comonomer(s) or a salt thereof.

In this case, the molecular weight is 500 to 500,000, preferably 2,000 to 100,000. The salt is an ammonium salt, a lower amine salt such as a monoethanolamine, diethanolamine, triethanolamine or triethylamine salt, or an alkali metal or an alkaline earth metal salt such as a sodium, potassium, calcium or magnesium salt. Representative examples of the comonomers include acrylic acid, methacrylic acid, vinyl acetate, acrylic ester, an olefin, allyl alcohol and adducts thereof with an ethylene oxide, and acrylamidemethylpropylsulfonic acid (AMPS).

Anionic surfactant (XIV)

This category includes a polymer of dicyclopentadienesulfonic acid or a salt thereof.

The molecular weight of the polymer is 500 to 500,000, preferably 2,000 to 100,000. The salt is an ammonium salt, a lower amine salt such as a monoethanolamine, diethanolamine, triethanolamine or triethylamine salt, or an alkali metal or an alkaline earth metal salt such as a sodium, potassium, calcium or magnesium salt.

Anionic surfactant (XV)

This category includes a copolymer of maleic anhydride or/and itaconic anhydride with other comonomer(s), or a salt thereof.

In this case, the molecular weight is 500 to 500,000, preferably 1,500 to 100,000. The salt is an ammonium salt or an alkali metal salt such as a sodium or potassium salt. Examples of the comonomers include olefins (ethylene, propylene, butylene, pentene, hexene, heptene, octerie, nonene, decene, undecene, dodecene, tridecene, tetradecene, pentadecene and hexadecene), styrene, vinyl acetate, acrylic esters, methacrylic acid and acrylic acid.

Anionic surfactant (XVI)

This category includes a maleinized liquid polybutadiene or a salt thereof.

The molecular weight of the liquid polybutadiene is 500 to 200,000, preferably 1,000 to 50,000. Although it will suffice when the degree of maleinization is such that it allows dissolution of the product in water, it is preferably 40 to 70%. The salt is an ammonium salt or an alkali metal salt such as a sodium or potassium salt.

Anionic surfactant (XVII)

This category includes an anionic surfactant having in its molecule one or two hydrophilic groups and selected from the group consisting of (a) to (h).

(a) A sulfuric ester salt of an alcohol having 4 to 18 carbon atoms.

The salt is an ammonium salt, a lower amine salt such as a monoethanolamine, diethanolamine, triethanolamine or triethylamine salt, or an alkali metal or an alkaline earth metal salt such as a sodium, potassium, magnesium or calcium salt. Representative examples thereof include sodium dodecyl sulfate and sodium octyl sulfate.

(b) An $C_{4-18}$ alkane-, alkene- or alkylarylsulfonic acid or a salt thereof.

The salt is an ammonium salt, a lower amine salt such as a monoethanolamine, diethanolamine, triethanolamine or triethylamine salt, or an alkali metal or an alkaline earth metal salt such as a sodium, potassium, magnesium or calcium salt. Representative examples thereof include sodium dodecylbenzenesulfonate, sodium butylnaphthalene-sulfonate and sodium dodecanesulfonate.

(c) A sulfate or phosphate of an adduct of a compound having in its molecule at least one active hydrogen with an alkylene oxide or a salt thereof.

The salt is an ammonium, sodium, potassium, magnesium or calcium salt. Representative examples thereof include a sodium salt of a sulfate of polyoxyethylene (3 mol) nonylphenyl ether and a sodium salt of a phosphate of polyoxyethylene (3 mol) dodecyl ether.

(d) A sulfosuccinic acid ester salt of a saturated or unsaturated alcohol having 4 to 22 carbon atoms.

The salt is an ammonium, sodium or potassium salt. Representative examples thereof include sodium and ammonium dioctyl sulfosuccinates and sodium dibutyl sulfosuccinate.

(e) An alkyldiphenyletherdisulfonic acid or a salt thereof.

The alkyl group has 8 to 18 carbon atoms, and the salt is an ammonium, sodium, potassium, magnesium or calcium salt.

(f) A tall rosin or a salt thereof, or a mixed tall acid comprising a tall rosin and a tall oil fatty acid.

The salt is an ammonium, sodium or potassium salt.

(g) An $C_{4-18}$ alkane or alkene fatty acid or a salt thereof.

The salt is an ammonium, potassium or sodium salt.

(h) An α-sulfofatty acid ester salt or a derivative thereof.

The α-sulfofatty acid ester salt is preferably those represented by the following general formula:

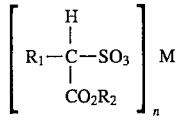

wherein $R_1$ represents an alkyl- or alkenylgroup having 6 to 22 carbon atoms, $R_2$ represents an alkyl group having 1 to 22 carbon atoms, M represents a mono- or divalent metal atom, that is, an alkali metal ion or an alkaline earth metal ion; an ammonium ion or an organic amine, and n is 1 or 2.

Among the above anionic surfactants, in particular, the salt of ligninsulfonic acid, the formalin condensate of ligninsulfonic acid and naphthalenesulfonic acid and salts thereof and the formalin condensate of a salt of naphthalenesulfonic acid exhibit an excellent performance as a whole.

Anionic surfactants having in its molecule a polycyclic aromatic ring which may have an alkyl group have a good affinity to the superheavy oil and exhibit an excellent performance as an emulsifier because they are similar to the superheavy oil in the structure.

The anionic surfactant serves to accelerate a further reduction in the particle size through adsorption on the interface of the particles of the superheavy oil and, at the same time, give electric charges to the particles to prevent the reagglomeration of the particles. Although the stability of the emulsion is greatly influenced by the temperature when only the nonionic surfactant is used, the addition of an anionic surfactant reduces the influence of the temperature, which contributes to an improvement in the storage stability of the emulsion. A further improvement in the storage stability can be attained by virtue of the action of the hydrophilic polymer described later.

Although the use of the anionic surfactant alone serves to lower the viscosity of the system, the storage stability becomes poor. On the other hand, when the nonionic surfactant is used alone, it is greatly influenced by the temperature, so that the viscosity of the system increases with the lapse of time and, in this case as well, it is impossible to provide an emulsion fuel having a good long-term stability. The combined use of the nonionic surfactant and the anionic surfactant enables a stable emulsion fuel to be provided. An excellent performance can be attained when the addition amount of the anionic surfactant is 0.5 to 300 parts by weight, preferably 5 to 100 parts by weight, based on 100 parts by weight of the nonionic surfactant.

Another preferable embodiment of the present invention is a superheavy oil emulsion fuel comprising a superheavy oil, water, a nonionic surfactant and a cationic or/and amphoteric surfactant. The cationic or/and amphoteric surfactants to be used in the present invention will be described in detail.

Cationic surfactant (I)

This category includes an alkyl- or alkenylamine salt produced by neutralizing an alkyl- or alkenylamine having 4 to 18 carbon atoms with an inorganic or organic acid.

Cationic surfactant (II)

This category includes a quaternary ammonium salt represented by the following formulae (1), (2) or (3):

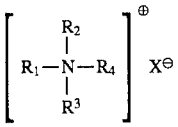

(1)

wherein $R_1$, $R_2$, $R_3$ and $R_4$ each represent an alkyl or alkenyl group having 1 to 18 carbon atoms and $X^{\theta}$ represents a counter anion,

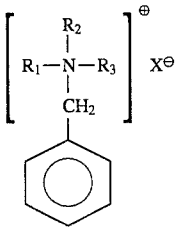

(2)

wherein $R_1$, $R_2$, $R_3$ and $X^{\theta}$ are as defined above, and

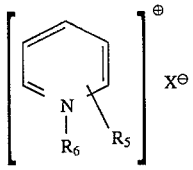

(3)

wherein $R_5$ represents an alkyl or alkenyl group having 8 to 18 carbon atoms, $R_6$ represents a hydrogen atom or a methyl group and $X^{\theta}$ is as defined above.

Amphoteric surfactant (III)

This category includes an alkyl- or alkenylbetaine represented by the following formula:

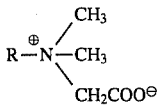

wherein R represents an alkyl or alkenyl group having 8 to 18 carbon atoms.

Cationic surfactant (IV)

This category includes an alkyl- or alkenylamine oxide represented by the following formula:

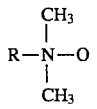

wherein R is as defined above.

Amphoteric surfactant (V)

This category includes an alkyl- or alkenylalanine represented by the following formula:

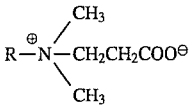

wherein R is as defined above.

Carbonic surfactant (VI)

This category includes a polyamiet represented by the following formulae (4) or (5):

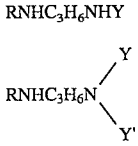

$$RNHC_3H_6NHY \quad (4)$$

$$RNHC_3H_6N(Y)(Y') \quad (5)$$

wherein R is as defined above and Y and Y' represent each an oxyethylene chain represented by the formula $-(C_2H_4O)_m-H$ wherein m is 1 to 50.

Cationic surfactant (VII)

This category includes a polyamine salt represented by the following formula (6):

$$RNHC_3H_6NH_2X' \quad (6)$$

wherein R is as defined above and X' represents an inorganic or organic acid.

Amphoteric surfactant (VIII)

This category includes an amphoteric imidazoline surfactant represented by the following formula:

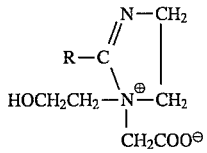

wherein R is as defined above.

Amphoteric surfactant (IX)

This category includes an amphoteric sulfobetaine surfactant represented by the following formula:

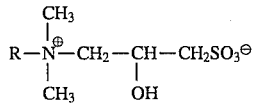

wherein R is as defined above.

The most significant feature attained by the use of the cationic or/and amphoteric surfactant described above resides in that the viscosity of the emulsion fuel can be lowered. However, when only the cationic or/and amphoteric surfactant is used as a surfactant, the function of maintaining the stability of the emulsion obtained is inferior to that of the nonionic surfactant. Therefore, it is suitable to use the cationic or/and amphoteric surfactant only when the emulsion fuel is burned in a relatively short time after the production thereof. On the other hand, the combined use of the nonionic surfactant with the cationic or/and amphoteric surfactant is followed in this embodiment of the present invention. Therefore, a superheavy oil emulsion fuel having a long-term stability and low viscosity is provided. Further, since the cationic and amphoteric surfactants can remarkably lower the viscosity of the system, the proportion of the superheavy oil in the emulsion can be enhanced in this embodiment of the present invention.

The cationic or/and amphoteric surfactant described above and used in the present invention adhere to the interface of the superheavy oil particles to promote a reduction in the size of the particles and, at the same time, give an electric charge to the particles to prevent reagglomeration of the particles.

In the present invention, the amount of addition of the cationic or/and amphoteric surfactant is 0.5 to 300 parts by weight, preferably 5 to 100 parts by weight, based on 100 parts by weight of the nonionic surfactant.

In practicing the present invention, when a hydrophilic polymer is further added to the superheavy oil emulsion, the strong protective function of the hydrophilic polymer allows the superheavy oil emulsion fuel to remain stable for a longer period of time. Examples of the hydrophilic polymer include the following polymers.

<Hydrophilic Polymers Derived from Naturally Occurring Matter>

The hydrophilic polymer derived from naturally occurring matter (including microorganisms) is preferably one member selected from the group consisting of hydrophilic polymers derived from microorganisms (A), plants (B) and animals (C) and naturally occurring polymer derivatives (D). These hydrophilic polymers become viscous or gel when it is dissolved or dispersed in water.

(A) Hydrophilic Polymers Derived from Microorganisms (Polysaccharides)
- (a) xanthan gum
- (b) pullulan
- (c) dextran (B) Hydrophilic Polymers Derived from Plants (Polysaccharides)
- (a) Derived from marine algae:
  - (i) agar
  - (ii) carrageenan
  - (iii) furcellaran
  - (iv) alginic acid and salts (Na, K, $NH_4$, Ca or Mg) thereof
- (b) Derived from seeds:
  - (i) locust bean gum
  - (ii) guar gum
  - (iii) tara gum
  - (iv) tamarind gum
- (c) Trees (exudates):
  - (i) gum arabic
  - (ii) gum karaya
  - (iii) gum tragacanth
- (d) Derived from fruits:
  - (i) pectin (C) Hydrophilic Polymers Derived from Animals (Proteins)
- (i) gelatin
- (ii) casein (D) Naturally Occurring Polymer Derivatives
- (i) cellulose derivatives (such as carboxymethylcellulose)
- (ii) chemically modified starch Among these hydrophilic polymers described above, xanthan gum in (A) is particularly excellent and exhibits an excellent performance even in a small amount.

<Hydrophilic, that is, Water-Soluble Synthetic Polymers>

(a) A homopolymer or copolymer of acrylic acid or a derivative thereof represented by the following formula:

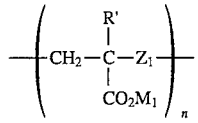

wherein R' represents a hydrogen atom, a methyl group or an ethyl group; $M_1$ represents a hydrogen atom, a sodium ion, a potassium ion, a lithium ion or an ammonium ion; $Z_1$ represents a divalent group derived from a monomer represented by the formula:

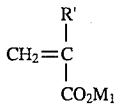

(wherein R' and $M_1$ are as defined above), a comonomer copolymerizable with the monomer or a salt of the comonomer, for example, maleic acid (anhydride), itaconic acid (anhydride), α-olefin, acrylamide, vinylsulfonic acid, allylsulfonic acid, methallylsulfonic acid, acrylamidomethylpropylsulfonic acid or a salt ($NH_4$, Na, K or Li) thereof, a dialkyl(methyl or ethyl)aminoethylmethacrylate or a salt (chloride, diethylsulfate or dimethylsulfate) thereof; and n is 50 to 100,000.

(b) A homopolymer or copolymer of acrylamide or a derivative thereof represented by the following formula:

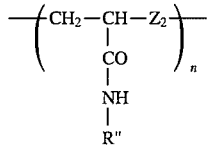

wherein R" represents a hydrogen atom or a $C_2H_4OH$ group; $Z_2$ represents a divalent group derived from a monomer represented by the formula:

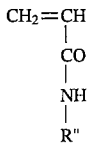

(wherein R" is as defined above), a comonomer copolymerizable with the monomer or a salt of the comonomer, for example, vinylsulfonic acid, allylsulfonic acid, methallylsulfonic acid, acrylamidomethylpropylsulfonic acid or a salt ($NH_4$, Na, K or Li) thereof, a dialkyl(methyl or ethyl)aminoethylmethacrylate or a salt (chloride, dimethylsulfate or diethylsulfate) thereof, styrene, α-olefins ($C_{2-18}$) and vinylallyl alcohol; and n is 50 to 100,000.

(c) A homopolymer of maleic anhydride or itaconic anhydride, or a copolymer thereof represented by the following formula:

wherein $M_2$ represents a maleic anhydride or itaconic anhydride residue; $Z_3$ represents an α-olefin (ethylene, propylene, butylene, isobutylene, octene, decene, dodecene or the like) or styrene residue; and n is 50 to 100,000.

(d) A homopolymer of vinyl alcohol, or a copolymer thereof represented by the following formula:

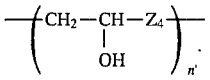

wherein $Z_4$ represents a vinyl acetate or styrene residue; and n' is 30 to 100,000.

(e) A homopolymer of vinylpyrrolidone, or a copolymer thereof represented by the following formula:

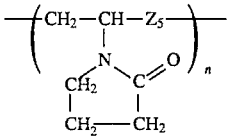

wherein $Z_5$ represents a divalent group derived from a comonomer copolymerizable with vinylpyrrolidone or a salt ($NH_4$, Na, K or Li) thereof, for example, acrylamide, vinylsulfonic acid, methallylsulfonic acid, maleic anhydride, itaconic anhydride or a salt ($NH_4$, Na, K or Li) thereof styrene, α-olefin ($C_{2-18}$) or the like; and n is 50 to 100,000.

(f) A polyalkylene oxide having a molecular weight of 10,000 to 5,000,000 (wherein the ethylene oxide content is 95% or more). It may contain in its molecule 5% or less of a block polymer of propylene oxide, butylene oxide or styrene oxide, or an alkylaryl or alkyl group.

When the superheavy oil emulsion fuel is piped or transported a long distance by sea after the production thereof, the emulsion fuel should remain stable and be free from thickening or phase separation for at least one month or advantageously for three months or more, if possible. A superheavy oil emulsion fuel containing the above surfactant alone and not containing the hydrophilic polymer undergoes a remarkable increase in the viscosity, the formation of a hard sediment, the agglomeration of particles to form a large mass or a separation of an oil within two to three weeks. The addition of the hydrophilic polymer to such a system can render the emulsion fuel stable over a period of one to three months or more.

The performance of the nonionic surfactant is greatly influenced by the temperature. A system emulsified at high temperature causes the emulsification stability to become poor with a lowering in the temperature. In order to emulsify an oil having a very high viscosity, such as a superheavy oil, it is a common practice to conduct the emulsification at a temperature of 60° C. or above, and sometimes at a temperature of 80° C. or above. When the emulsion is stored, transported by sea or piped, the temperature thereof becomes very close to that of the region or season, and thus it sometimes reaches 0° C. or below. Since the effect of imparting hydrophilicity attained by the hydrophilic polymer is large, the addition of the hydrophilic polymer can compensate for a lowering in the performance of the nonionic surfactant caused by the lowering of the temperature.

The hydrophilic polymer is used in an amount of preferably 0.01 to 1% by weight, still more preferably 0.1 to 0.5% by weight, in the superheavy oil emulsion fuel, that is, based on whole amount of the superheavy oil emulsion fuel. An increase in the amount of addition of the hydrophilic polymer leads to an increase in the viscosity of the system and is also disadvantageous in profitability, so that it is preferred to attain the desired effect with a minimized amount of addition.

The system of three additives, that is, the anionic surfactant, the nonionic surfactant and the hydrophilic polymer or the cationic or/and amphoteric surfactant, the nonionic surfactant and the hydrophilic polymer, and the system of two additives, that is, the nonionic surfactant and the hydrophilic polymer, the anionic surfactant and the nonionic surfactant or the cationic or/and amphoteric surfactant and the nonionic surfactant may be prepared in advance. Alternatively, the additives may be added separately from each other. Although the additives slay be added to any of the water and the oil, the addition of the additives to water is favorable from the viewpoint of handleability.

Further, the additives may be added in the course of the production of the superheavy oil. Bitumen such as Orinoco tar is produced by the steam injection method. In this step, it is possible to use the above combination of the anionic surfactant with the nonionic surfactant and the hydrophilic polymer, the combination of the cationic or/and amphoteric surfactant with the nonionic surfactant and the hydrophilic polymer, the combination of the nonionic surfactant with the hydrophilic polymer, the combination of the anionic surfactant with the nonionic surfactant or the combination of the cationic or/and amphoteric surfactant with the nonionic surfactant. Namely, the above-described surfactant or/and hydrophilic polymer, and steam are added to the oil well of Bitumen to produce an emulsion, and then Bitumen is taken with the surfactant or/and hydrophilic polymer. Alternatively, the above combination may be used to prepare an emulsion fuel after extraction followed by removal of sand and other solid particles or desalting.

Mechanical means used for the production of an emulsion fuel may be any method as long as it is an efficient agitating means. This means may comprise a combination of two methods. The use of a high-shear agitating device is particularly preferred. Examples of the high-shear agitating device include a line mixer and a device having an arrow feather type turbine blade, a propeller blade, a Brumagin-type blade or a paddle blade. The shear rate is 1,100 $sec^{-1}$ or above, preferably 4,000 to 90,000 $sec^{-1}$.

The methods for regenerating a deteriorated O/W superheavy oil emulsion fuel according to the present invention will be described in detail.

In the present invention, the deteriorated O/W superheavy oil emulsion fuel is regenerated by the following two methods depending upon the extent of deterioration.

(1) Method for regenerating an O/W superheavy oil emulsion fuel deteriorated to such a slight extent that the emulsion fuel can be pumped and handled as a fluid liquid: 0.01 to 2 parts by weight, preferably 0.05 to 0.5 parts by weight, based on 100 parts by weight of an emulsion fuel deteriorated, of a nonionic surfactant selected from the group consisting of the above-described nonionic surfactants (i), (ii), (iii) and (iv) or a nonionic surfactant selected from the group consisting of the above-described nonionic surfactants (v), (vi), (vii) and (viii) is agitated together with the emulsion fuel by means of a high-shear agitator such as a line mixer, to regenerate an O/W superheavy oil emulsion fuel which can be sufficiently atomized at a high temperature, for example, 80° to 90° C., and having a low unburned content. In order to improve the combustibility, it is preferred to select the HLB value and amount of addition of the nonionic surfactant in such a manner that the emulsion is of an O/W type at the temperatures of production, storage and transportation and turns into a W/O type at the atomization temperature.

(2) Method for regenerating an O/W superheavy oil emulsion fuel deteriorated to such a remarkable extent that emulsion fuel has such a high viscosity that the pumping thereof is difficult and it cannot be handled as a fluid liquid:

An emulsion fuel which has a good fluidity and can be sufficiently atomized at a high temperature, for example, 80° to 90° C., can be regenerated by adding both an anionic surfactant selected from the group consisting of the above-described anionic surfactants (XI), (XII), (XIII), (XIV), (XV), (XVI) and (XVII) and a nonionic surfactant having a HLB value of 8 to 16, preferably 10 to 14, and selected from the group consisting of the above-described nonionic surfactants (i), (ii), (iii) and (iv) or a nonionic surfactant having a HLB value of 8 to 16, preferably 10 to 14, and selected from the group consisting of the above-described nonionic surfactants (v), (vi), (vii) and (viii) in such a proportion that the weight ratio of the anionic surfactant to the nonionic surfactant is in the range of from 10/1 to 1/10, preferably in the range of from 1/1 to 1/4, and the total amount of the anionic surfactant and the nonionic surfactant is 0.01 to 3 parts by weight, preferably 0.3 to 1.5 parts by weight, based on 100 parts by weight of the deteriorated emulsion fuel, and then agitating the resultant mixture.

The anionic surfactant serves mainly to lower the viscosity of the emulsion fuel, while the nonionic surfactant serves mainly to prevent emulsion particles from aggregating and coalescing, and to disperse emulsion particles for a long period of time. In order to improve the combustibility, it is preferred to select the HLB value and amount of addition of the emulsifier in such a manner that the emulsion is of an O/W type at the temperatures of production (regeneration), storage and transportation and turns into a W/O type at the atomization temperature.

Among the above-described anionic surfactants, those belonging to anionic surfactants (XI) and (XII) provide better results. Those belonging to the anionic surfactant (XI) have somewhat superior performance. Among various anionic surfactants (XI), no significant difference in the performance is observed so far as the degree of condensation is 2 or more. Among various anionic surfactants (XII), somewhat superior performance can be attained when use is made of a modified lignin wherein a carboxylic acid group is introduced instead of the sulfonic acid group.

In both the above-described methods (1) and (2), use may be made of any agitation method or a combination of two or more agitation methods so far as the agitation can be efficiently conducted. The use of a high-shear agitation device is particularly preferred. Examples thereof include a line mixer and a device having a fan turbine blade, a propeller blade, a Brumagin blade or a paddle blade.

BRIEF DESCRIPTION OF THE DRAWING

FIG. 1 is a schematic view of a centrifuge tube used for the evaluation of the dispersed state after standing, wherein 1 is the surface layer, 2 is the intermediate layer and 3 is the sedimentation layer.

EXAMPLES

The following describes Examples of the present invention, but the present invention is not limited to these Examples only.

Example A-1

Middle Eastern petroleum-derived asphalt [penetration (JIS K 2207 (1980)): 60–80] or Athabasca bitumen [softening temperature (JIS K 2207 (1980)): 12.5° C.; native to Canada], water and a surfactant were weighed respectively in given amounts in a total amount of 300 g into an 800-ml centrifuge tube and heated to 75° C. After the temperature of the mixture became constant, the mixture was agitated with a TK homomixer (provided with a low-viscosity agitation blade), manufactured by Tokushu Kika Kogyo Co., Ltd., to prepare an emulsion fuel, and stored at 60° C. After the temperature of the emulsion fuel became constant, the viscosity of the fuel was measured with Model VS-A1 Vismetron (No. 2 rotor, number of revolutions of the rotor: 60 rpm) manufactured by Shibaura Systems Co., Ltd. Part of the emulsion fuel was maintained at 50° C., and the state of the emulsion fuel was observed 1, 3 and 9 days after the initiation of the storage. Part thereof was taken out to measure the percentage undersize of a 100-mesh sieve. The percentage sieve undersize was determined by putting about 10 g of a sample on a 100-mesh stainless sieve of 70 mmϕ in an atmosphere of at 50° C., measuring the oversize after 10 min, and calculating the undersize. The results obtained when use was made of petroleum-derived asphalt are given in Tables 2 to 6, and the results obtained when use was made of Athabasca bitumen are given in Tables 7 and 8.

The overall evaluation was conducted by collectively evaluating the viscosity of the emulsion, percentage sieve undersize, and visual observation of the dispersed state 9 days after the initiation of standing of the emulsion. The overall evaluation is better in the following order: o>Δ>x, that is, o is good, Δ is medium and x is bad. The effect according to the present invention is observed in the systems of which the overall evaluation is x-α or better. Namely, the case that the overall evaluation is x-Δ, Δ, Δ-o or o exhibited an effect as compared with the blank wherein no surfactant was used.

With respect to the dispersed state after standing, the states of three layers as shown in FIG. 1, i.e., surface layer 1, intermediate layer 2 and sedimentation layer 3, were observed, and separately evaluated.

In the surface layer 1, the size of oil drops present on the surface and the size of an oil film formed by the growth of the oil drops were observed. The dispersed state is better in the following order: "no oil drop">"small amt. of oil drop">"no oil film"≧"large amt. of oil drop">"small amt. of oil film>" large amt. of oil film". Namely, "no oil drop" is best and "large amt. of oil film" is worst.

In the intermediate layer 2, the emulsified state was observed. The emulsified state is better in the following order: "excellent emulsification">"slightly creamy state">"creamy state">"separated">"remarkable separation">"complete separation". Namely, "excellent emulsification" is best and "complete separation" is worst.

In the sedimentation layer 3, the state is better in the following order: "no sediment">"soft sediment">"hard sediment". Namely, "no sediment" is best and "hard sediment" is worst. The soft sediment is a sediment which is soft and easily redispersible, while the hard sediment is a sediment which is hard and difficult to redisperse.

TABLE 2

| Test No. | Asphalt concn. (%) | Surfactant and its amt. (%): nonionic surfactant | Surfactant and its amt. (%): anionic surfactant | Properties as produced: viscosity (c.p.: 60° C.) | Properties as produced: sieve (100-mesh) undersize (%) | Observation of dispersed state after initiation of standing: after 1 day | after 3 days | after 9 days | Overall evaluation |
|---|---|---|---|---|---|---|---|---|---|
| 1 | 74 | polyoxyethylene nonylphenyl ether (HLB: 15.5) 0.40 | — | 4050 | 15 | large amt. of oil film creamy state no sediment | large amt. of oil film creamy state no sediment | large amt. of oil film creamy state soft sediment | X |
| 2 | 74 | polyoxyethylene nonylphenyl ether (HLB: 15.5) 0.60 | — | 4170 | 17 | large amt. of oil film creamy state no sediment | large amt. of oil film creamy state no sediment | large amt. of oil film creamy state soft sediment | X |
| 3 | 74 | polyoxyethylene nonylphenyl ether (HLB: 15.5) 0.40 | sodium lignin-sulfonate 0.20 | 248 | 43 | small amt. of oil film excellent emulsification no sediment | small amt. of oil film excellent emulsification no sediment | large amt. of oil film excellent emulsification soft sediment | Δ |
| 4 | 74 | polyoxyethylene dodecyl ether (HLB: 15.5) 0.40 | — | 5200 | 10 | large amt. of oil film creamy state no sediment | large amt. of oil film creamy state no sediment | large amt. of oil film creamy state soft sediment | X |
| 5 | 74 | polyoxyethylene dodecyl ether (HLB: 15.5) 0.60 | — | 4800 | 11 | large amt. of oil film creamy state no sediment | large amt. of oil film creamy state no sediment | large amt. of oil film creamy state soft sediment | X |
| 6 | 74 | polyoxyethylene dodecyl ether (HLB: 15.5) 0.40 | sodium lignin-sulfonate 0.20 | 380 | 43 | small amt. of oil film excellent emulsification no sediment | small amt. of oil film excellent emulsification no sediment | large amt. of oil film excellent emulsification soft sediment | Δ |
| 7 | 74 | oxyethylene adduct of tall oil fatty acid (HLB: 15.5) 0.40 | — | 1500 | 35 | small amt. of oil film creamy state no sediment | small amt. of oil film creamy state no sediment | large amt. of oil film creamy state soft sediment | Δ |

TABLE 3

| Test No. | Asphalt concn. (%) | Surfactant and its amt. (%): nonionic surfactant | Surfactant and its amt. (%): anionic surfactant | Properties as produced: viscosity (c.p.: 60° C.) | Properties as produced: sieve (100-mesh) undersize (%) | Observation of dispersed state after initiation of standing: after 1 day | after 3 days | after 9 days | Overall evaluation |
|---|---|---|---|---|---|---|---|---|---|
| 8 | 74 | oxyethylene adduct of tall oil fatty acid (HLB: 15.5) 0.40 | sodium lignin-sulfonate 0.20 | 260 | 56 | no oil film excellent emulsification no sediment | small amt. of oil film excellent emulsification no sediment | small amt. of oil film excellent emulsification no sediment | ○ |
| 9 | 74 | oxyethylene adduct of tall rosin* (HLB: 15.5) 0.40 | — | 1200 | 34 | small amt. of oil film creamy state no sediment | small amt. of oil film creamy state no sediment | large amt. of oil film creamy state soft sediment | Δ |
| 10 | 74 | oxyethylene adduct of tall rosin* (HLB: 15.5) 0.40 | sodium lignin-sulfonate 0.20 | 240 | 58 | no oil film excellent emulsification no sediment | small amt. of oil film excellent emulsification no sediment | small amt. of oil film excellent emulsification no sediment | ○ |
| 11 | 74 | oxyethylene adduct of mixed tall acid comprising tall oil fatty acid and tall rosin* (HLB: 14.0) 0.40 | — | 1300 | 30 | small amt. of oil film creamy state no sediment | large amt. of oil film creamy state no sediment | large amt. of oil film creamy state soft sediment | X–Δ |
| 12 | 74 | oxyethylene adduct of mixed tall acid comprising tall oil fatty acid and tall rosin* (HLB: 15.5) | — | 960 | 36 | small amt. of oil film creamy state no sediment | small amt. of oil film creamy state no sediment | large amt. of oil film creamy state soft sediment | Δ |

TABLE 3-continued

| Test No. | Asphalt concn. (%) | Surfactant and its amt. (%) nonionic surfactant | anionic surfactant | Properties as produced viscosity (c.p.: 60° C.) | sieve (100-mesh) undersize (%) | Observation of dispersed state after initiation of standing after 1 day | after 3 days | after 9 days | Overall evaluation |
|---|---|---|---|---|---|---|---|---|---|
| 13 | 74 | 0.40 oxyethylene adduct of mixed tall acid comprising tall oil fatty acid and tall rosin* (HLB: 18.0) 0.40 | — | 1400 | 32 | small amt. of oil film creamy state no sediment | large amt. of oil film creamy state no sediment | large amt. of oil film creamy state soft sediment | X–Δ |
| 14 | 74 | oxyethylene adduct of mixed tall acid comprising tall oil fatty acid and tall rosin* (HLB: 19.0) 0.40 | — | 1900 | 30 | small amt. of oil film creamy state no sediment | large amt. of oil film creamy state no sediment | large amt. of oil film creamy state soft sediment | X–Δ |

Note)
*: "tall rosin" may be called as "tall rosin acid" or "tall resin acid".

TABLE 4

| Test No. | Asphalt concn. (%) | Surfactant and its amt. (%) nonionic surfactant | anionic surfactant | Properties as produced viscosity (c.p.: 60° C.) | sieve (100-mesh) undersize (%) | Observation of dispersed state after initiation of standing after 1 day | after 3 days | after 9 days | Overall evaluation |
|---|---|---|---|---|---|---|---|---|---|
| 15 | 74 | oxyethylene adduct of mixed tall acid comprising tall oil fatty acid and tall rosin* (HLB: 19.3) 0.40 | — | 2500 | 25 | small amt. of oil film creamy state no sediment | large amt. of oil film creamy state no sediment | large amt. of oil film creamy state soft sediment | X—Δ |
| 16 | 74 | oxyethylene adduct of mixed tall acid comprising tall oil fatty acid and tall rosin* (HLB: 15.5) 0.30 | — | 1050 | 35 | small amt. of oil film creamy state no sediment | small amt. of oil film creamy state no sediment | large amt. of oil film creamy state soft sediment | Δ |
| 17 | 74 | oxyethylene adduct of mixed tall acid comprising tall oil fatty acid and tall rosin* (HLB: 15.5) 0.60 | — | 960 | 38 | small amt. of oil film creamy state no sediment | small amt. of oil film creamy state no sediment | large amt. of oil film creamy state soft sediment | Δ |
| 18 | 70 | oxyethylene adduct of mixed tall acid comprising tall oil fatty acid and tall rosin* (HLB: 15.5) 0.40 | — | 820 | 37 | small amt. of oil film creamy state no sediment | small amt. of oil film creamy state no sediment | large amt. of oil film creamy state soft sediment | Δ |
| 19 | 77 | oxyethylene adduct of mixed tall acid comprising tall oil fatty acid and tall rosin* (HLB: 15.5) 0.40 | — | 2900 | 24 | small amt. of oil film creamy state no sediment | large amt. of oil film creamy state no sediment | large amt. of oil film creamy state soft sediment | X–Δ |
| 20 | 74 | oxyethylene adduct of mixed tall acid comprising tall oil fatty acid and tall rosin* (HLB: 15.5) | sodium lignin-sulfonate 0.05 | 650 | 34 | small amt. of oil film excellent emulsification no sediment | small amt. of oil film excellent emulsification no sediment | small amt. of oil film excellent emulsification soft sediment | Δ–○ |

TABLE 4-continued

| Test No. | Asphalt concn. (%) | Surfactant and its amt. (%) nonionic surfactant | anionic surfactant | Properties as produced viscosity (c.p.: 60° C.) | sieve (100-mesh) undersize (%) | Observation of dispersed state after initiation of standing after 1 day | after 3 days | after 9 days | Overall evaluation |
|---|---|---|---|---|---|---|---|---|---|
| 21 | 74 | 0.40 oxyethylene adduct of mixed tall acid comprising tall oil fatty acid and tall rosin* (HLB: 15.5) 0.40 | sodium lignin-sulfonate 0.10 | 280 | 50 | no oil drop excellent emulsification no sediment | small amt. of oil drop excellent emulsification no sediment | small amt. of oil film excellent emulsification no sediment | ○ |

TABLE 5

| Test No. | Asphalt concn. (%) | Surfactant and its amt. (%) nonionic surfactant | anionic surfactant | Properties as produced viscosity (c.p.: 60° C.) | sieve (100-mesh) undersize (%) | Observation of dispersed state after initiation of standing after 1 day | after 3 days | after 9 days | Overall evaluation |
|---|---|---|---|---|---|---|---|---|---|
| 22 | 74 | oxyethylene adduct of mixed tall acid comprising tall oil fatty acid and tall rosin* (HLB: 15.5) 0.40 | sodium lignin-sulfonate 0.20 | 180 | 62 | no oil drop excellent emulsification no sediment | small amt. of oil drop excellent emulsification no sediment | small amt. of oil film excellent emulsification no sediment | ○ |
| 23 | 74 | oxyethylene adduct of mixed tall acid comprising tall oil fatty acid and tall rosin* (HLB: 15.5) 0.40 | sodium lignin-sulfonate 0.60 | 200 | 55 | small amt. of oil drop excellent emulsification no sediment | small amt. of oil film excellent emulsification no sediment | small amt. of oil film excellent emulsification no sediment | ○ |
| 24 | 74 | oxyethylene adduct of mixed tall acid comprising tall oil fatty acid and tall rosin* (HLB: 15.5) 0.40 | sodium lignin-sulfonate 1.30 | 200 | 42 | small amt. of oil film excellent emulsification no sediment | large amt. of oil film excellent emulsification soft sediment | large amt. of oil film excellent emulsification part of soft sediment hardened | X–Δ |
| 25 | 74 | oxyethylene adduct of mixed tall acid comprising tall oil fatty acid and tall rosin* (HLB: 15.5) 0.40 | potassium oleate 0.20 | 350 | 56 | no oil film excellent emulsification no sediment | no oil film excellent excellent emulsification no sediment | small amt. of oil film excellent emulsification no sediment | ○ |
| 26 | 74 | oxyethylene adduct of mixed tall acid comprising tall oil fatty acid and tall rosin* (HLB: 15.5) 0.40 | sodium salt of mixed acid comprising tall oil fatty acid and tall rosin* (0.20) | 240 | 62 | no oil drop excellent emulsification no sediment | no oil drop excellent emulsification no sediment | small amt. of oil drop excellent emulsification no sediment | ○ |
| 27 | 74 | oxyethylene adduct of mixed tall acid comprising tall oil fatty acid and tall rosin* (HLB: 15.5) 0.40 | sodium alkyl-benzene-sulfonate 0.20 | 280 | 60 | no oil drop excellent emulsification no sediment | no oil drop excellent emulsification no sediment | small amt. of oil drop excellent emulsification no sediment | ○ |

TABLE 6

| Test No. | Asphalt concn. (%) | Surfactant and its amt. (%): nonionic surfactant | Surfactant and its amt. (%): anionic surfactant | Properties as produced: viscosity (c.p.: 60° C.) | Properties as produced: sieve (100-mesh) undersize (%) | Observation of dispersed state after initiation of standing: after 1 day | after 3 days | after 9 days | Overall evaluation |
|---|---|---|---|---|---|---|---|---|---|
| 28 | 74 | oxyethylene adduct of benzoic acid (HLB: 15.5) 0.40 | — | 2400 | 29 | small amt. of oil film creamy state no sediment | large amt. of oil film creamy state soft sediment | large amt. of oil film creamy state soft sediment | X–Δ |
| 29 | 74 | oxyethylene adduct of benzoic acid (HLB: 15.5) 0.40 | sodium lignin-sulfonate 0.20 | 480 | 34 | small amt. of oil film excellent emulsification no sediment | small amt. of oil film excellent emulsification no sediment | small amt. of oil film excellent emulsification soft sediment | Δ–○ |
| 30 | 74 | — | sodium lignin-sulfonate 0.20 | 86 | 0 | large amt. of oil film complete separation hard sediment | large amt. of oil film complete separation hard sediment | large amt. of oil film complete separation hard sediment | X |
| 31 | 74 | — | sodium lignin-sulfonate 0.60 | 77 | 0 | large amt. of oil film complete separation hard sediment | large amt. of oil film complete separation hard sediment | large amt. of oil film complete separation hard sediment | X |

TABLE 7

| Test No. | Athabasca bitumen concn. (%) | Surfactant and its amt. (%): nonionic surfactant | Surfactant and its amt. (%): anionic surfactant | Properties as produced: viscosity (c.p.: 60° C.) | Properties as produced: sieve (100-mesh) undersize (%) | Observation of dispersed state after initiation of standing: after 1 day | after 3 days | after 9 days | Overall evaluation |
|---|---|---|---|---|---|---|---|---|---|
| 1 | 74 | polyoxyethylene nonylphenyl ether (HLB: 15.5) 0.40 | — | 3500 | 10 | large amt. of oil film creamy state no sediment | large amt. of oil film creamy state no sediment | large amt. of oil film creamy state no sediment | X |
| 2 | 74 | polyoxyethylene nonylphenyl ether (HLB: 15.5) 0.60 | — | 3400 | 12 | large amt. of oil film creamy state no sediment | large amt. of oil film creamy state no sediment | large amt. of oil film creamy state no sediment | X |
| 3 | 74 | polyoxyethylene nonylphenyl ether (HLB: 15.5) 0.40 | sodium lignin-sulfonate 0.20 | 220 | 44 | small amt. of oil film excellent emulsification no sediment | small amt. of oil film excellent emulsification no sediment | large amt. of oil film creamy state soft sediment | Δ |
| 4 | 74 | oxyethylene adduct of tall oil fatty acid (HLB: 15.5) 0.40 | — | 1700 | 34 | small amt. of oil film creamy state no sediment | small amt. of oil film creamy state no sediment | large amt. of oil film creamy state soft sediment | Δ |
| 5 | 74 | oxyethylene adduct of tall oil fatty acid (HLB: 15.5) 0.40 | sodium lignin-sulfonate 0.20 | 290 | 53 | no oil film excellent emulsification no sediment | small amt. of oil film excellent emulsification no sediment | small amt. of oil film excellent emulsification soft sediment | ○ |

TABLE 8

| Test No. | Athabasca bitumen concn. (%) | Surfactant and its amt. (%): nonionic surfactant | Surfactant and its amt. (%): anionic surfactant | Properties as produced: viscosity (c.p.: 60° C.) | Properties as produced: sieve (100-mesh) undersize (%) | Observation of dispersed state after initiation of standing: after 1 day | after 3 days | after 9 days | Overall evaluation |
|---|---|---|---|---|---|---|---|---|---|
| 6 | 74 | oxyethylene adduct of tall rosin* (HLB: 15.5) 0.40 | — | 1250 | 34 | small amt. of oil film creamy state no sediment | small amt. of oil film creamy state no sediment | large amt. of oil film creamy state soft sediment | Δ |
| 7 | 74 | oxyethylene adduct of tall rosin* (HLB: 15.5) 0.40 | sodium lignin-sulfonate 0.20 | 250 | 56 | no oil film excellent emulsification no sediment | no oil film excellent emulsification no sediment | no oil film excellent emulsification soft sediment | ○ |
| 8 | 74 | oxyethylene adduct of mixed tall acid comprising tall oil fatty acid and tall rosin* (HLB: 15.5) 0.40 | — | 990 | 36 | small amt. of oil film creamy state no sediment | small amt. of oil film creamy state no sediment | large amt. of oil film creamy state soft sediment | Δ |
| 9 | 74 | oxyethylene adduct of mixed tall acid comprising tall oil fatty acid and tall rosin* (HLB: 15.5) 0.40 | sodium lignin-sulfonate 0.20 | 200 | 60 | no oil film excellent emulsification no sediment | no oil film excellent emulsification no sediment | no oil film excellent emulsification no sediment | ○ |

Example A-2

Middle Eastern petroleum-derived asphalt [penetration (JIS K 2207 (1980)): 60–80] or Athabasca bitumen [softening temperature (JIS K 2207 (1980)): 12.5° C.; native to Canada], water, a surfactant and a hydrophilic polymer were weighed respectively in predetermined amounts in a total amount of 800 g into an 800-ml centrifuge tube and heated to 75° C. After the temperature of the mixture became constant, the mixture was agitated with a TK homomixer (provided with a low-viscosity agitation blade), manufactured by Tokushu Kika Kogyo Co., Ltd., to prepare an emulsion fuel, and stored at 60° C. After the temperature of the emulsion fuel became constant, the viscosity of the fuel was measured with Model VS-A1 Vismetron (No. 2 rotor, number of revolutions of the roter: 80 rpm) manufactured by Shibaura Systems Co., Ltd. Part of the emulsion fuel was maintained at 50° C., and the state of the emulsion fuel was observed 1 day, 9 days and 6 months after the initiation of the storage. The dispersed state after standing was evaluated with the same criteria as those described in Example A-1. Part of the emulsion fuel was taken out to measure the percentage undersize of a 100-mesh sieve. The percentage sieve undersize was determined by putting about 10 g of a sample on a 100-mesh stainless sieve of 70 mmϕ in an atmosphere of at 50° C., [56e measuring the oversize after 10 min, and calculating the undersize.

The results are given in Tables 9 to 11.

The overall evaluation was conducted by collectively evaluating the viscosity of the emulsion, percentage sieve undersize, and visual observation of the dispersed state 6 months after the initiation of standing of the emulsion. The overall evaluation is better in the following order: o>Δ>x, that is, o is good, Δ is medium and x is bad. The effect according to the present invention is observed to some extent in the systems of which the overall evaluation is x-Δ or better. Namely, the case that the overall evaluation is x-Δ, Δ, Δ-o or o exhibited an effect as compared with the blank wherein no surfactant was used.

TABLE 9

| Test No. | Asphalt concn. (%) | Surfactant, stabilizer and amt. thereof (%): nonionic surfactant | anionic surfactant | stabilizer | Properties as produced: viscosity (c.p.: 60° C.) | sieve (100-mesh) undersize (%) | Observation of dispersed state after initiation of standing: after 1 day | after 9 days | after 6 months | Overall evaluation |
|---|---|---|---|---|---|---|---|---|---|---|
| 1 | 74 | polyoxyethylene nonylphenyl ether (HLB: 15.5) 0.40 | sodium lignin-sulfonate 0.20 | — | 248 | 43 | small amt. of oil film excellent emulsification no sediment | large amt. of oil film excellent emulsification soft sediment | large amt. of oil film creamy state hard sediment | X–Δ |
| 2 | 74 | polyoxyethylene nonylphenyl ether (HLB: 15.5) | sodium lignin-sulfonate | xanthan gum 0.05 | 420 | 60 | no oil drop excellent emulsification | no oil drop excellent emulsification | small amt. of oil film creamy state | Δ |

TABLE 9-continued

| Test No. | Asphalt concn. (%) | Surfactant, stabilizer and amt. thereof (%): nonionic surfactant | anionic surfactant | stabilizer | Properties as produced: viscosity (c.p.: 60° C.) | sieve (100-mesh) undersize (%) | Observation of dispersed state after initiation of standing: after 1 day | after 9 days | after 6 months | Overall evaluation |
|---|---|---|---|---|---|---|---|---|---|---|
| 3 | 74 | 0.40 polyoxyethylene nonylphenyl ether (HLB: 15.5) 0.40 | 0.20 — | xanthan gum 0.05 | 740 | 46 | no sediment small amt. of oil drop excellent emulsification no sediment | no sediment small amt. of oil drop excellent emulsification no sediment | soft sediment small amt. of oil film creamy state soft sediment | Δ |
| 4 | 74 | polyoxyethylene dodecyl ether (HLB: 15.5) 0.40 | sodium lignin-sulfonate 0.20 | — | 380 | 43 | small amt. of oil film excellent emulsification no sediment | large amt. of oil film excellent emulsification soft sediment | large amt. of oil film creamy state hard sediment | X–Δ |
| 5 | 74 | polyoxyethylene dodecyl ether (HLB: 15.5) 0.40 | sodium lignin-sulfonate 0.20 | xanthan gum 0.05 | 480 | 61 | no oil drop excellent emulsification no sediment | no oil drop excellent emulsification no sediment | small amt. of oil film creamy state soft sediment | Δ |
| 6 | 74 | oxyethylene adduct of mixed tall acid comprising tall oil fatty acid and tall rosin* (HLB: 15.5) 0.40 | — | xanthan gum 0.05 | 720 | 50 | small amt. of oil drop excellent emulsification no sediment | small amt. of oil drop excellent emulsification no sediment | small amt. of oil drop excellent emulsification soft sediment | Δ–○ |

TABLE 10

| Test No. | Asphalt concn. (%) | Surfactant, stabilizer and amt. thereof (%): nonionic surfactant | anionic surfactant | stabilizer | Properties as produced: viscosity (c.p.: 60° C.) | sieve (100-mesh) undersize (%) | Observation of dispersed state after initiation of standing: after 1 day | after 9 days | after 6 months | Overall evaluation |
|---|---|---|---|---|---|---|---|---|---|---|
| 7 | 74 | oxyethylene adduct of mixed tall acid comprising tall oil fatty acid and tall rosin* (HLB: 15.5) 0.40 | sodium lignin-sulfonate 0.20 | — | 180 | 62 | no oil drop excellent emulsification no sediment | small amt. of oil drop excellent emulsification no sediment | small amt. of oil film creamy state soft sediment | Δ |
| 8 | 74 | oxyethylene adduct of mixed tall acid comprising tall oil fatty acid and tall rosin* (HLB: 15.5) 0.40 | sodium lignin-sulfonate 0.20 | xanthan gum 0.03 | 450 | 60 | no oil drop excellent emulsification no sediment | no oil drop excellent emulsification no sediment | small amt. of oil drop excellent emulsification soft sediment | ○ |
| 9 | 74 | oxyethylene adduct of mixed tall acid comprising tall oil fatty acid and tall rosin* (HLB: 15.5) 0.40 | sodium lignin-sulfonate 0.20 | xanthan gum 0.05 | 460 | 68 | no oil drop excellent emulsification no sediment | no oil drop excellent emulsification no sediment | no oil drop excellent emulsification no sediment | ○ |
| 10 | 74 | oxyethylene adduct of mixed tall acid comprising tall oil fatty acid and tall rosin* (HLB: 15.5) 0.40 | sodium lignin-sulfonate 0.20 | hydroxy-ethyl-cellulose 0.05 | 450 | 64 | no oil drop excellent emulsification no sediment | no oil drop excellent emulsification no sediment | small amt. of oil drop excellent emulsification no sediment | ○ |
| 11 | 74 | oxyethylene | sodium | locust | 420 | 67 | no oil drop | no oil drop | small amt. of | ○ |

TABLE 10-continued

| Test No. | Asphalt concn. (%) | Surfactant, stabilizer and amt. thereof (%) nonionic surfactant | anionic surfactant | stabilizer | Properties as produced viscosity (c.p.: 60° C.) | sieve (100-mesh) undersize (%) | Observation of dispersed state after initiation of standing after 1 day | after 9 days | after 6 months | Overall evaluation |
|---|---|---|---|---|---|---|---|---|---|---|
| | | adduct of mixed tall acid comprising tall oil fatty acid and tall rosin* (HLB: 15.5) 0.40 | lignin-sulfonate 0.20 | bean gum 0.05 | | | excellent emulsification no sediment | excellent emulsification no sediment | oil drop excellent emulsification no sediment | |
| 12 | 74 | oxyethylene adduct of mixed tall acid comprising tall oil fatty acid and tall rosin* (HLB: 15.5) 0.40 | sodium lignin-sulfonate 0.20 | oxidized starch 0.05 | 420 | 65 | no oil drop excellent emulsification no sediment | no oil drop excellent emulsification no sediment | small amt. of oil drop excellent emulsification no sediment | ○ |

TABLE 11

| Test No. | Athabasca bitumen concn. (%) | Surfactant, stabilizer and amt. thereof (%) nonionic surfactant | anionic surfactant | stabilizer | Properties as produced viscosity (c.p.: 60° C.) | sieve (100-mesh) undersize (%) | Observation of dispersed state after initiation of standing after 1 day | after 9 days | after 6 months | Overall evaluation |
|---|---|---|---|---|---|---|---|---|---|---|
| 1 | 74 | polyoxyethylene nonylphenyl ether (HLB: 15.5) 0.40 | sodium lignin-sulfonate 0.20 | — | 158 | 74 | small amt. of oil film excellent emulsification no sediment | large amt. of oil film excellent emulsification soft sediment | large amt. of oil film creamy state hard sediment | X–Δ |
| 2 | 74 | polyoxyethylene nonylphenyl ether (HLB: 15.5) 0.40 | sodium lignin-sulfonate 0.20 | xanthan gum 0.05 | 360 | 76 | no oil drop excellent emulsification no sediment | no oil drop excellent emulsification no sediment | small amt. of oil film slightly creamy state soft sediment | Δ |
| 3 | 74 | oxyethylene adduct of mixed tall acid comprising tall oil fatty acid and tall rosin* (HLB: 15.5) 0.40 | sodium lignin-sulfonate 0.20 | — | 290 | 53 | no oil drop excellent emulsification no sediment | small amt. of oil drop excellent emulsification soft sediment | small amt. of oil film creamy state soft sediment | Δ |
| 4 | 74 | oxyethylene adduct of mixed tall acid comprising tall oil fatty acid and tall rosin* (HLB: 15.5) 0.40 | sodium lignin-sulfonate 0.20 | xanthan gum 0.05 | 320 | 75 | no oil drop excellent emulsification no sediment | no oil drop excellent emulsification no sediment | small amt. of oil drop excellent emulsification no sediment | ○ |
| 5 | 74 | oxyethylene adduct of mixed tall acid comprising tall oil fatty acid and tall rosin* (HLB: 15.5) 0.40 | sodium lignin-sulfonate 0.20 | hydroxy-ethyl-cellulose 0.05 | 350 | 76 | no oil drop excellent emulsification no sediment | no oil drop excellent emulsification no sediment | small amt. of oil drop excellent emulsification no sediment | ○ |
| 6 | 74 | oxyethylene adduct of mixed tall acid comprising tall oil fatty acid and tall rosin* (HLB: 15.5) | sodium lignin-sulfonate 0.20 | locust bean gum 0.05 | 360 | 74 | no oil drop excellent emulsification no sediment | no oil drop excellent emulsification no sediment | small amt. of oil drop excellent emulsification no sediment | ○ |

TABLE 11-continued

| Test No. | Athabasca bitumen concn. (%) | Surfactant, stabilizer and amt. thereof (%) nonionic surfactant | anionic surfactant | stabilizer | Properties as produced viscosity (c.p.: 60° C.) | sieve (100-mesh) undersize (%) | Observation of dispersed state after initiation of standing after 1 day | after 9 days | after 6 months | Overall evaluation |
|---|---|---|---|---|---|---|---|---|---|---|
| | | 0.40 | | | | | | | | |

Example B-1

Emulsion fuels were prepared with the use of Middle Eastern petroleum-derived asphalt [penetration (JIS K 2207 (1980)): 60–80] or Athabasca bitumen [softening temperature (JIS K 2207 (1980)): 12.5° C.; native to Canada], water and a surfactant in the same manner as that described in Example A-1. The properties of the emulsion fuels thus obtained were evaluated in the same manner as those described in Example A-1.

The results obtained when use was made of petroleum-derived asphalt are given in Tables 12 to 14, and the results obtained when use was made of Athabasca bitumen are given in Tables 15 and 16.

TABLE 12

| Test No. | Asphalt concn. (%) | Surfactant and its amt. (%) nonionic surfactant | cationic or amphoteric surfactant | Properties as produced viscosity (c.p.: 60° C.) | sieve (100-mesh) undersize (%) | Observation of dispersed state after initiation of standing after 1 day | after 3 days | after 9 days | Overall evaluation |
|---|---|---|---|---|---|---|---|---|---|
| 1 | 74 | polyoxyethylene nonylphenyl ether (HLB: 15.5) 0.40 | — | 4050 | 15 | large amt. of oil film creamy state no sediment | large amt. of oil film creamy state no sediment | large amt. of oil film creamy state soft sediment | X |
| 2 | 74 | polyoxyethylene nonylphenyl ether (HLB: 15.5) 0.40 | dodecyl-dimethyl-betaine 0.20 | 206 | 47 | no oil drop excellent emulsification no sediment | no oil drop excellent emulsification no sediment | small amt. of oil film creamy state soft sediment | Δ |
| 3 | 74 | polyoxyethylene dodecyl ether (HLB 15.5) 0.40 | — | 5200 | 10 | large amt. of oil film creamy state no sediment | large amt. of oil film creamy state no sediment | large amt. of oil film creamy state soft sediment | X |
| 4 | 74 | polyoxyethylene dodecyl ether (HLB: 15.5) 0.40 | dodecyl-dimethyl-betaine 0.20 | 380 | 42 | no oil drop excellent emulsification no sediment | no oil drop excellent emulsification no sediment | small amt. of oil film creamy state soft sediment | Δ |
| 5 | 74 | oxyethylene adduct of tall oil fatty acid (HLB: 15.5) 0.40 | — | 1500 | 35 | small amt. of oil film creamy state no sediment | small amt. of oil film creamy state no sediment | large amt. of oil film creamy state soft sediment | Δ |
| 6 | 74 | oxyethylene adduct of tall oil fatty acid (HLB: 15.5) 0.40 | dodecyl-dimethyl-betaine 0.20 | 230 | 53 | no oil drop excellent emulsification no sediment | no oil drop excellent emulsification no sediment | small amt. of oil drop excellent emulsification no sediment | ○ |

TABLE 13

| Test No. | Asphalt concn. (%) | Surfactant and its amt. (%) nonionic surfactant | cationic or amphoteric surfactant | Properties as produced viscosity (c.p.: 60° C.) | sieve (100-mesh) undersize (%) | Observation of dispersed state after initiation of standing after 1 day | after 3 days | after 9 days | Overall evaluation |
|---|---|---|---|---|---|---|---|---|---|
| 7 | 74 | oxyethylene adduct of tall rosin* (HLB: 15.5) 0.40 | — | 1200 | 34 | small amt. of oil film creamy state no sediment | small amt. of oil film creamy state no sediment | large amt. of oil film creamy state soft sediment | Δ |
| 8 | 74 | oxyethylene | dodecyl- | 480 | 52 | no oil film | small amt. of | small amt. of | ○ |

TABLE 13-continued

| Test No. | Asphalt concn. (%) | Surfactant and its amt. (%): nonionic surfactant | Surfactant and its amt. (%): cationic or amphoteric surfactant | Properties as produced: viscosity (c.p.: 60° C.) | Properties as produced: sieve (100-mesh) undersize (%) | Observation of dispersed state after initiation of standing: after 1 day | after 3 days | after 9 days | Overall evaluation |
|---|---|---|---|---|---|---|---|---|---|
| | | adduct of tall rosin* (HLB: 15.5) 0.40 | dimethyl-betaine 0.20 | | | excellent emulsification no sediment | oil film excellent emulsification no sediment | oil film excellent emulsification no sediment | |
| 9 | 74 | oxyethylene adduct of mixed tall acid comprising tall oil fatty acid and tall rosin* (HLB: 15.5) 0.40 | — | 960 | 36 | small amt. of oil film creamy state no sediment | small amt. of oil film creamy state no sediment | large amt. of oil film creamy state soft sediment | Δ |
| 10 | 74 | oxyethylene adduct of mixed tall acid comprising tall oil fatty acid and tall rosin* (HLB: 15.5) 0.40 | dodecyl-dimethyl-betaine 0.20 | 250 | 58 | no oil drop excellent emulsification no sediment | no oil drop excellent emulsification no sediment | small amt. of oil drop excellent emulsification no sediment | ○ |
| 11 | 74 | oxyethylene adduct of mixed tall acid comprising tall oil fatty acid and tall rosin* (HLB: 15.5) 0.40 | dodecyl-dimethyl-betaine 0.10 | 360 | 50 | no oil drop excellent emulsification no sediment | small amt. of oil drop excellent emulsification no sediment | large amt. of oil drop excellent emulsification soft sediment | ○ |
| 12 | 74 | oxyethylene adduct of mixed tall acid comprising tall oil fatty acid and tall rosin* (HLB: 15.5) 0.40 | dodecyl-dimethyl-betaine 0.60 | 450 | 46 | no oil drop excellent emulsification no sediment | no oil drop excellent emulsification no sediment | small amt. of oil film excellent emulsification no sediment | ○ |

TABLE 14

| Test No. | Asphalt concn. (%) | Surfactant and its amt. (%): nonionic surfactant | Surfactant and its amt. (%): cationic or amphoteric surfactant | Properties as produced: viscosity (c.p.: 60° C.) | Properties as produced: sieve (100-mesh) undersize (%) | Observation of dispersed state after initiation of standing: after 1 day | after 3 days | after 9 days | Overall evaluation |
|---|---|---|---|---|---|---|---|---|---|
| 13 | 74 | oxyethylene adduct of mixed tall acid comprising tall oil fatty acid and tall rosin* (HLB: 15.5) 0.40 | dodecyl-dimethyl-amine oxide 0.20 | 280 | 47 | no oil drop excellent emulsification no sediment | no oil drop excellent emulsification no sediment | small amt. of oil drop excellent emulsification soft sediment | ○ |
| 14 | 74 | oxyethylene adduct of mixed tall acid comprising tall oil fatty acid and tall rosin* (HLB: 15.5) 0.40 | dodecyl-trimethyl-ammonium chloride 0.20 | 300 | 45 | no oil drop excellent emulsification no sediment | no oil drop excellent emulsification no sediment | small amt. of oil drop excellent emulsification soft sediment | ○ |
| 15 | 74 | oxyethylene adduct of mixed tall acid comprising tall oil fatty acid and tall rosin* (HLB: 15.5) 0.40 | dodecyl-diamiet 0.20 | 500 | 35 | no oil drop excellent emulsification no sediment | small amt. of oil film excellent emulsification no sediment | small amt. of oil film creamy state soft sediment | Δ–○ |
| 16 | 74 | oxyethylene adduct of mixed tall acid comprising tall oil fatty acid and | dodecyl-amine hydro-chloride | 510 | 28 | small amt. of oil drop excellent emulsification | small amt. of oil film excellent emulsification | small amt. of oil film creamy state no sediment | Δ–○ |

TABLE 14-continued

| Test No. | Asphalt concn. (%) | Surfactant and its amt. (%): nonionic surfactant | Surfactant and its amt. (%): cationic or amphoteric surfactant | Properties as produced: viscosity (c.p.: 60° C.) | Properties as produced: sieve (100-mesh) undersize (%) | Observation of dispersed state after initiation of standing: after 1 day | after 3 days | after 9 days | Overall evaluation |
|---|---|---|---|---|---|---|---|---|---|
| | | tall rosin* (HLB: 15.5) 0.40 | 0.20 | | | no sediment | no sediment | | |

TABLE 15

| Test No. | Athabasca concn. (%) | Surfactant and its amt. (%): nonionic surfactant | Surfactant and its amt. (%): cationic or amphoteric surfactant | Properties as produced: viscosity (c.p.: 60° C.) | Properties as produced: sieve (100-mesh) undersize (%) | Observation of dispersed state after initiation of standing: after 1 day | after 3 days | after 9 days | Overall evaluation |
|---|---|---|---|---|---|---|---|---|---|
| 1 | 74 | polyoxyethylene nonylphenyl ether (HLB: 15.5) 0.40 | — | 3500 | 10 | large amt. of oil film creamy state no sediment | large amt. of oil film creamy state no sediment | large amt. of oil film creamy state no sediment | X |
| 2 | 74 | polyoxyethylene nonylphenyl (HLB: 15.5) 0.40 | dodecyl-dimethyl-betaine 0.20 | 220 | 44 | small amt. of oil film excellent emulsification no sediment | small amt. of oil film excellent emulsification no sediment | large amt. of oil film cream state soft sediment | Δ |
| 3 | 74 | oxyethylene adduct of tall oil fatty acid (HLB: 15.5) 0.40 | — | 1700 | 34 | small amt. of oil film creamy state no sediment | small amt. of oil film creamy state no sediment | large amt. of oil film creamy state soft sediment | Δ |
| 4 | 74 | oxyethylene adduct of tall oil fatty acid (HLB: 15.5) 0.40 | dodecyl-dimethyl-betaine 0.20 | 320 | 52 | no oil film excellent emulsification no sediment | small amt. of oil film excellent emulsification no sediment | small amt. of oil film excellent emulsification soft sediment | ○ |
| 5 | 74 | oxyethylene adduct of tall rosin* (HLB: 15.5) 0.40 | — | 1250 | 34 | small amt. of oil film creamy state no sediment | small amt. of oil film creamy state no sediment | large amt. of oil film creamy state soft sediment | Δ |
| 6 | 74 | oxyethylene adduct of tall rosin* (HLB: 15.5) 0.40 | dodecyl-dimethyl-betaine 0.20 | 270 | 55 | no oil film excellent emulsification no sediment | no oil film excellent emulsification no sediment | no oil film excellent emulsification soft sediment | ○ |

TABLE 16

| Test No. | Athabasca concn. (%) | Surfactant and its amt. (%): nonionic surfactant | Surfactant and its amt. (%): cationic or amphoteric surfactant | Properties as produced: viscosity (c.p.: 60° C.) | Properties as produced: sieve (100-mesh) undersize (%) | Observation of dispersed state after initiation of standing: after 1 day | after 3 days | after 9 days | Overall evaluation |
|---|---|---|---|---|---|---|---|---|---|
| 7 | 74 | oxyethylene adduct of mixed tall acid comprising tall oil fatty acid and tall rosin* (HLB: 15.5) 0.40 | — | 990 | 36 | small amt. of oil film creamy state no sediment | small amt. of oil film creamy state no sediment | large amt. of oil film creamy state soft sediment | Δ |
| 8 | 74 | oxyethylene adduct of mixed tall acid comprising tall oil fatty acid and tall rosin* (HLB: 15.5) 0.40 | dodecyl-dimethyl-betaine 0.20 | 180 | 58 | no of oil film excellent emulsification no sediment | no of oil film excellent emulsification no sediment | no oil film excellent emulsification no sediment | ○ |
| 9 | 74 | oxyethylene adduct of mixed tall | dodecyl-dimethyl- | 560 | 46 | no oil film excellent | no oil film excellent | small amt. of oil film | ○ |

TABLE 16-continued

| Test No. | Atha-basca concn. (%) | Surfactant and its amt. (%): nonionic surfactant | Surfactant and its amt. (%): cationic or amphoteric surfactant | Properties as produced: viscosity (c.p.: 60° C.) | Properties as produced: sieve (100-mesh) undersize (%) | Observation of dispersed state after initiation of standing: after 1 day | after 3 days | after 9 days | Over-all eval-uation |
|---|---|---|---|---|---|---|---|---|---|
| | | acid comprising tall oil fatty acid and tall rosin* (HLB: 15.5) 0.40 | betaine 0.05 | | | emulsification no sediment | emulsification no sediment | excellent emulsification soft sediment | |
| 10 | 74 | oxyethylene adduct of mixed tall acid comprising tall oil fatty acid and tall rosin* (HLB: 15.5) 0.40 | dodecyl-dimethyl-betaine 0.20 | 420 | 50 | no oil film excellent emulsification no sediment | no oil film excellent emulsification no sediment | small amt. of oil film excellent emulsification soft sediment | ○ |
| 11 | 74 | oxyethylene adduct of mixed tall acid comprising tall oil fatty acid and tall rosin* (HLB: 15.5) 0.40 | dodecyl-dimethyl-betaine 0.80 | 350 | 38 | no oil film excellent emulsification no sediment | small amt. of oil film excellent emulsification no sediment | small amt. of oil film creamy state soft sediment | Δ–○ |
| 12 | 74 | oxyethylene adduct of mixed tall acid comprising tall oil fatty acid and tall rosin* (HLB: 15.5) 0.40 | dodecyl-trimethyl-ammonium chloride 0.20 | 240 | 53 | no oil film excellent emulsification no sediment | no oil film excellent emulsification no sediment | no oil film excellent emulsification no sediment | ○ |

Example B-2

Emulsion fuels were prepared with the use of Middle Eastern petroleum-derived asphalt [penetration (JIS K 2207 (1980)): 60–80] or Athabasca bitumen [softening temperature (JIS K 2207 (1980)): 12.5° C.; native to Canada], water, a surfactant and a hydrophilic polymer in the same manner as that described in Example A-2. The properties of the emulsion fuels thus obtained were evaluated in the same manner as that described in Example A-2.

The results obtained when use was made of petroleum-derived asphalt are given in Tables 17 and 18, and the results obtained when use was made of Athabasca bitumen are given in Table 19.

TABLE 17

| Test No. | As-phalt concn. (%) | Surfactant. stabilizer and amt. thereof (%): nonionic surfactant | Surfactant. stabilizer and amt. thereof (%): cationic or amphoteric surfactant | Surfactant. stabilizer and amt. thereof (%): stabilizer | Properties as produced: vis-cosity (c.p.: 60° C.) | Properties as produced: sieve (100-mesh) undersize (%) | Observation of dispersed state after initiation of standing: after 1 day | after 9 days | after 6 months | Over-all eval-uation |
|---|---|---|---|---|---|---|---|---|---|---|
| 1 | 74 | polyoxyethylene nonylphenyl ether (HLB: 15.5) 0.40 | dodecyl-dimethyl-betaine 0.20 | — | 206 | 47 | no oil drop excellent emulsification no sediment | small amt. of oil film creamy state soft sediment | large amt. of oil film creamy state hard sediment | X–Δ |
| 2 | 74 | polyoxyethylene nonylphenyl ether (HLB: 15.5) 0.40 | dodecyl-dimethyl-betaine 0.20 | xanthan gum 0.05 | 225 | 48 | no oil drop excellent emulsification no sediment | no oil drop excellent emulsification no sediment | large amt. of oil film creamy state soft sediment | Δ |
| 3 | 74 | polyoxyethylene dodecyl ether (HLB 15.5) 0.40 | dodecyl-dimethyl-betaine 0.20 | — | 380 | 42 | no oil drop excellent emulsification no sediment | small amt. of oil film creamy state soft sediment | large amt. of oil film creamy state hard sediment | X–Δ |
| 4 | 74 | polyoxyethylene dodecyl ether (HLB: 15.5) 0.40 | dodecyl-dimethyl-betaine 0.20 | xanthan gum 0.05 | 370 | 40 | no oil drop excellent emulsification no sediment | no oil drop excellent emulsification no sediment | large amt. of oil film creamy state soft sediment | Δ |
| 5 | 74 | oxyethylene adduct of mixed tall acid comprising tall oil fatty | dodecyl-dimethyl-betaine 0.20 | — | 250 | 58 | no oil drop excellent emulsification no sediment | small amt. of oil droplet excellent emulsification | large amt. of oil film creamy state soft sediment | Δ |

TABLE 17-continued

| Test No. | Asphalt concn. (%) | Surfactant. stabilizer and amt. thereof (%) nonionic surfactant | cationic or amphoteric surfactant | stabilizer | Properties as produced viscosity (c.p.: 60° C.) | sieve (100-mesh) undersize (%) | Observation of dispersed state after initiation of standing after 1 day | after 9 days | after 6 months | Overall evaluation |
|---|---|---|---|---|---|---|---|---|---|---|
| | | acid and tall rosin* (HLB: 15.5) 0.40 | | | | | | no sediment | | |
| 6 | 74 | oxyethylene adduct of mixed tall acid comprising tall oil fatty acid and tall rosin* (HLB: 15.5) 0.40 | dodecyl-dimethyl-betaine 0.20 | xanthan gum 0.05 | 260 | 62 | no oil drop excellent emulsification no sediment | no oil drop excellent emulsification no sediment | small amt. of oil drop excellent emulsification no sediment | ○ |

TABLE 18

| Test No. | Asphalt concn. (%) | Surfactant. stabilizer and amt. thereof (%) nonionic surfactant | cationic or amphoteric surfactant | stabilizer | Properties as produced viscosity (c.p.: 60° C.) | sieve (100-mesh) undersize (%) | Observation of dispersed state after initiation of standing after 1 day | after 9 days | after 6 months | Overall evaluation |
|---|---|---|---|---|---|---|---|---|---|---|
| 7 | 74 | oxyethylene adduct of mixed tall acid comprising tall oil fatty acid and tall rosin* (HLB: 15.5) 0.40 | dodecyl-dimethyl-betaine 0.20 | hydroxy-methyl-cellulose 0.05 | 290 | 60 | no oil drop excellent emulsification no sediment | no oil drop excellent emulsification no sediment | small amt. of oil drop excellent emulsification no sediment | ○ |
| 8 | 74 | oxyethylene adduct of mixed tall acid comprising tall oil fatty acid and tall rosin* (HLB: 15.5) 0.40 | dodecyl-dimethyl-betaine 0.20 | locust bean gum 0.05 | 310 | 59 | no oil drop excellent emulsification no sediment | no oil drop excellent emulsification no sediment | small amt. of oil film excellent emulsification no sediment | ○ |
| 9 | 74 | oxyethylene adduct of mixed tall acid comprising tall oil fatty acid and tall rosin* (HLB: 15.5) 0.40 | dodecyl-dimethyl-betaine 0.20 | oxidized starch 0.05 | 300 | 60 | no oil drop excellent emulsification no sediment | no oil drop excellent emulsification no sediment | small amt. of oil drop excellent emulsification no sediment | ○ |

TABLE 19

| Test No. | Athabasca bitumen concn. (%) | Surfactant. stabilizer and amt. thereof (%) nonionic surfactant | cationic or amphoteric surfactant | stabilizer | Properties as produced viscosity (c.p.: 60° C.) | sieve (100-mesh) undersize (%) | Observation of dispersed state after initiation of standing after 1 day | after 9 days | after 6 months | Overall evaluation |
|---|---|---|---|---|---|---|---|---|---|---|
| 1 | 74 | polyoxyethylene | dodecyl- | — | 220 | 44 | small amt. of | large amt. of | large amt. of | X–Δ |

TABLE 19-continued

| Test No. | Athabasca bitumen concn. (%) | Surfactant, stabilizer and amt. thereof (%): nonionic surfactant | cationic or amphoteric surfactant | stabilizer | Properties as produced: viscosity (c.p.: 60° C.) | sieve (100-mesh) undersize (%) | Observation of dispersed state after initiation of standing: after 1 day | after 9 days | after 6 months | Overall evaluation |
|---|---|---|---|---|---|---|---|---|---|---|
| | | nonylphenyl ether (HLB: 15.5) 0.40 | dimethyl-betaine 0.20 | | | | oil film excellent emulsification no sediment | oil film creamy state soft sediment | oil film creamy state hard sediment | |
| 2 | 74 | polyoxyethylene nonylphenyl ether (HLB: 15.5) 0.40 | dodecyl-dimethyl-betaine 0.20 | xanthan gum 0.05 | 360 | 56 | no oil drop excellent emulsification no sediment | no oil drop excellent emulsification no sediment | small amt. of oil film creamy state soft sediment | Δ |
| 3 | 74 | oxyethylene adduct of mixed tall acid comprising tall oil fatty acid and tall rosin* (HLB: 15.5) 0.40 | dodecyl-dimethyl-betaine 0.20 | — | 180 | 58 | no oil film excellent emulsification no sediment | no oil film excellent emulsification no sediment | small amt. of oil film creamy state soft sediment | Δ |
| 4 | 74 | oxyethylene adduct of mixed tall acid comprising tall oil fatty acid and tall rosin* (HLB: 15.5) 0.40 | dodecyl-dimethyl-betaine 0.20 | xanthan gum 0.05 | 300 | 70 | no oil drop excellent emulsification no sediment | no oil drop excellent emulsification no sediment | small amt. of oil drop excellent emulsification no sediment | ○ |
| 5 | 74 | oxyethylene adduct of mixed tall acid comprising tall oil fatty acid and tall rosin* (HLB: 15.5) 0.40 | dodecyl-dimethyl-betaine 0.20 | hydroxy-ethyl-cellulose 0.05 | 350 | 66 | no oil drop excellent emulsification no sediment | no oil drop excellent emulsification no sediment | small amt. of oil drop excellent emulsification no sediment | ○ |
| 6 | 74 | oxyethylene adduct of mixed tall acid comprising tall oil fatty acid and tall rosin* (HLB: 15.5) 0.40 | dodecyl-dimethyl-betaine 0.20 | locust bean gum 0.05 | 330 | 64 | no oil drop excellent emulsification no sediment | no oil drop excellent emulsification no sediment | small amt. of oil film excellent emulsification soft sediment | Δ–○ |

Example C-1

An 800-ml SUS vessel was charged with 300 g of a slightly deteriorated O/W superheavy oil emulsion fuel, immersed in a heating bath and heated to 60° C. A predetermined amount of a nonionic surfactant was added thereto. After the temperature of the mixture became constant (60° C.), the system was agitated with a paddle agitating blade at 300 rpm for 5 min. Further, the system was subjected to high-shear agitation with a TK homomixer, manufactured by Tokushu Kika Kogyo Co., Ltd., at 6000 rpm for 2 min, thereby conducting re-emulsification, and then placed in a thermostated bath at 60° C. to measure the viscosity of the re-emulsified emulsion fuel. Part of the re-emulsified emulsion fuel was maintained at 50° C. and taken out to measure the percentage undersize of a 100-mesh sieve. The measurement of the viscosity and the percentage undersize of a 100-mesh sieve were conducted in the same manner as those described in Example A-1.

The results are given in Tables 20 and 21.

In the overall evaluation, all of the results were considered. The overall evaluation is better in the following order: o>Δ>x, that is, o is good, Δ is medium and x is bad.

The above-described slightly deteriorated emulsion fuel was prepared by adding 0.12 part by weight of ligninsulfonic acid and 0.48 part by weight of polyoxyethylene nonylphenyl ether (HLB: 15.2) to 100 parts by weight of Middle Eastern petroleum-derived asphalt [penetration (JIS K 2207 (1980)): 60–80] or Athabasca bitumen [softening temperature (JIS K 2207 (1980)): 12.5° C.; native to Canada], agitating them at 75° C. with a TK homomixer (provided with a low-viscosity agitation blade), manufactured by Tokushu Kika Kogyo Co., Ltd., to produce an emulsion fuel and storing the emulsion fuel at 50° C. for one month.

TABLE 20

| Test No. | Asphalt concn. (%) | Surfactant and its amt. (%) | Properties as produced: viscosity (c.p.; 60° C.) | Properties as produced: sieve (100-mesh) undersize (%) | Overall evaluation |
|---|---|---|---|---|---|
| 1 | 74 | no surfactant added (blank) 0.00 | 4300 | 0 | X |
| 2 | 74 | polyoxyethylene nonylphenyl ether (HLB: 12.4) 0.08 | 480 | 37 | Δ |
| 3 | 74 | polyoxyethylene nonylphenyl ether (HLB: 12.4) 0.30 | 220 | 76 | ○ |
| 4 | 74 | oxyethylene adduct of mixed tall acid comprising tall oil fatty acid and tall rosin* (HLB: 12.4) 0.05 | 500 | 38 | Δ |
| 5 | 74 | oxyethylene adduct of mixed tall acid comprising tall oil fatty acid and tall rosin* (HLB: 12.4) 0.08 | 240 | 76 | ○ |
| 6 | 74 | oxyethylene adduct of mixed tall acid comprising tall oil fatty acid and tall rosin* (HLB: 12.4) 0.30 | 210 | 78 | ○ |

TABLE 21

| Test No. | Athabasca concn. (%) | Surfactant and its amt. (%) | Properties as produced: viscosity (c.p.; 60° C.) | Properties as produced: sieve (100-mesh) undersize (%) | Overall evaluation |
|---|---|---|---|---|---|
| 1 | 74 | no surfactant added (blank) 0.00 | 3800 | 0 | X |
| 2 | 74 | polyoxyethylene nonylphenyl ether (HLB: 12.4) 0.08 | 520 | 34 | Δ |
| 3 | 74 | oxyethylene adduct of mixed tall acid comprising tall oil fatty acid and tall rosin* (HLB: 12.4) 0.05 | 510 | 33 | Δ |
| 4 | 74 | oxyethylene adduct of mixed tall acid comprising tall oil fatty acid and tall rosin* (HLB: 12.4) 0.08 | 210 | 75 | ○ |
| 5 | 74 | oxyethylene adduct of tall rosin* (HLB: 12.4) 0.08 | 240 | 72 | ○ |

Example C-2

An 800-ml SUS vessel was charged with 800 g of a remarkably deteriorated O/W superheavy oil emulsion fuel, immersed in a heating bath and heated to 60° C. A predetermined amount of a mixture of an anionic surfactant with a nonionic surfactant was added thereto, and the system was subjected to high-shear agitation with a TK homomixer, manufactured by Tokushu Kika Kogyo Co., Ltd., at 6000 rpm for 2 min and then placed in a thermostated bath at 60° C. to measure the viscosity. Part of the emulsion fuel was maintained at 50° C. and taken out to measure the percentage undersize of a 100-mesh sieve. The measurement of the viscosity and the percentage undersize of a 100-mesh sieve were conducted in the same manner as those described in Example A-1.

The results are given in Tables 22 and 23.

In the overall evaluation, all of the results were considered. The overall evaluation is better in the following order: o>Δ>x, that is, o is good, Δ is medium and x is bad.

The above-described remarkably deteriorated O/W superheavy emulsion fuel was prepared by adding 1.0 part by weight of polyoxyethylene nonylphenyl ether (HLB: 15.5) to 100 parts by weight of Middle Eastern petroleum-derived asphalt [penetration (JIS K 2207 (1980)): 60–80] or Athabasca bitumen [softening temperature (JIS K 2207 (1980)): 12.5° C.; native to Canada], agitating them at 75° C. with a TK homomixer (provided with a low-viscosity agitation blade), manufactured by Tokushu Kika Kogyo Co., Ltd., to produce an emulsion fuel and storing the emulsion fuel at 50° C. for one month. The viscosity of the emulsion fuel was 500 c.p. as produced and 7000 c.p. one month after the initiation of the storage.

TABLE 22

| Test No. | Asphalt concn. (%) | Surfactant and its amt. (%) | Properties as produced: viscosity (c.p.; 60° C.) | Properties as produced: sieve (100-mesh) undersize (%) | Overall evaluation |
|---|---|---|---|---|---|
| 1 | 74 | no surfactant added (blank) 0.00 | 7,000 | 0 | X |
| 2 | 74 | system of sodium ligninsulfonate/ polyoxyethylene nonylphenyl ether (HLB: 12.4) (weight ratio 1/2) with sum of both compounds varied as follows: | | | |
| | | 0.08 | 6,000 | 0 | X |
| | | 0.10 | 3,000 | 2 | Δ |
| | | 0.30 | 400 | 50 | ○ |
| | | 1.50 | 250 | 75 | ○ |
| | | 2.00 | 1,000 | 25 | Δ |
| 3 | 74 | system of sodium ligninsulfonate/ oxyethylene adduct of mixed tall acid comprising tall oil fatty acid and tall rosin* (HLB: 12.4) (weight ratio 1/2) with sum of both compounds varied as follows: | | | |
| | | 0.08 | 2,800 | 5 | Δ |
| | | 0.10 | 500 | 46 | ○ |
| | | 0.30 | 280 | 70 | ○ |
| | | 1.50 | 220 | 72 | ○ |
| | | 2.00 | 1,100 | 27 | Δ |

TABLE 23

| Test No. | Athabasca bitumen concn. (%) | Surfactant and its amt. (%) | Properties as produced: viscosity (c.P. 60° C.) | Properties as produced: sieve (100-mesh) undersize (%) | Overall evaluation |
|---|---|---|---|---|---|
| 1 | 74 | no surfactant added (blank) 0.00 | 6,000 | 0 | X |
| 2 | 74 | system of sodium ligninsulfonate/ polyoxyethylene nonylphenyl ether (HLB: 12.4) (weight ratio 1/2) with sum of both compounds varied as follows: | | | |
| | | 0.08 | 4,800 | 2 | X |
| | | 0.10 | 2,300 | 6 | Δ |
| | | 0.30 | 300 | 58 | ○ |
| | | 1.50 | 210 | 78 | ○ |
| | | 2.00 | 800 | 29 | Δ |
| 3 | 74 | system of sodium ligninsulfonate/ oxyethylene adduct of mixed tall acid comprising tall oil fatty acid and tall rosin* (HLB: 12.4) (weight ratio 1/2) with sum of both compounds varied as follows: | | | |
| | | 0.08 | 2,000 | 8 | Δ |

TABLE 23-continued

| Test No. | Athabasca bitumen concn. (%) | Surfactant and its amt. (%) | Properties as produced: viscosity (c.P. 60° C.) | sieve (100-mesh) undersize (%) | Overall evaluation |
|---|---|---|---|---|---|
| | | 0.10 | 500 | 62 | ○ |
| | | 0.30 | 240 | 76 | ○ |
| | | 1.50 | 220 | 75 | ○ |
| | | 2.00 | 1,000 | 26 | Δ |

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What we claim is:

1. A superheavy oil emulsion fuel consisting essentially of in a mixed and emulsified state, 100 parts by weight of a superheavy oil, 25 to 80 parts by weight of water and 0.02 to 5 parts by weight of a nonionic surfactant selected from the group consisting of the following nonionic surfactants (i), (ii), (iii) and (iv):

nonionic surfactant (i)

an alkylene oxide adduct of a tall oil fatty acid, a tall rosin, a gum rosin, a wood rosin or a mixture thereof, nonionic surfactant (ii)

a mono- or/and diester of a tall oil fatty acid, a tall rosin, a gum rosin, a wood rosin or a mixture thereof with an alkylene oxide polymer;

nonionic surfactant (iii)

an alkylene oxide adduct of an aromatic ring compound having in its molecule one or more carboxyl groups and derived from petroleum or coal; and nonionic surfactant (iv)

a mono- or/and diester of an aromatic ring compound having in its molecule one or more carboxyl groups and derived from petroleum or coal with an alkylene oxide polymer.

2. The superheavy oil emulsion fuel according to claim 1, which further contains 0.5 to 300 parts by weight, based on 100 parts by weight of the nonionic surfactant, of a surfactant selected from the group consisting of the following cationic surfactants (I), (II), (IV), (VI) and (VII) and amphoteric surfactants (III), (V), (VIII) and (IX):

cationic surfactant (I)

an alkyl- or alkenylamine salt produced by neutralizing an alkyl- or alkenylamine having 4 to 18 carbon atoms with an inorganic or organic acid;

cationic surfactant (II)

a quaternary ammonium salt represented by the following formulae (1), (2) or (3):

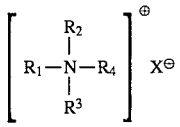

(1)

wherein $R_1$, $R_2$, $R_3$ and $R_4$ each represent an alkyl or alkenyl group having 1 to 18 carbon atoms and $X^{\theta}$ represents a counter anion,

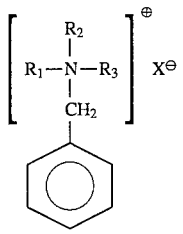

(2)

wherein $R_1$, $R_2$, $R_3$ and $X^{\theta}$ are as defined above, and

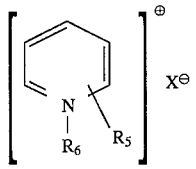

(3)

wherein $R_5$ represents an alkyl or alkenyl group having 8 to 18 carbon atoms, $R_6$ represents a hydrogen atom or a methyl group and $X^{\theta}$ is as defined above;

amphoteric surfactant (III)

an alkyl- or alkenylbetaine represented by the following formula:

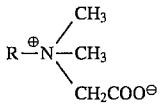

wherein R represents an alkyl or alkenyl group having 8 to 18 carbon atoms;

cationic surfactant (IV)

an alkyl- or alkenylamine oxide represented by the following formula:

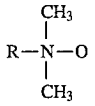

wherein R is as defined above;

amphoteric surfactant (V)

an alkyl- or alkenylalanine represented by the following formula:

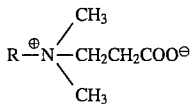

wherein R is as defined above;

cationic surfactant (VI)

a polyamiet represented by the following formulae (4) or (5):

$$RNHC_3H_6NHY \quad (4)$$

$$RNHC_3H_6N(Y)(Y') \quad (5)$$

wherein R is as defined above and Y and Y' represent each an oxyethylene chain represented by the formula $-(C_2H_4O)_m-H$ wherein m is 1 to 50;

cationic surfactant (VII)

a polyamine salt represented by the following formula (6):

$$RNHC_3H_6NH_2X' \quad (6)$$

wherein R is as defined above and X' represents an inorganic or organic acid;

amphoteric surfactant (VIII)

an amphoteric imidazoline surfactant represented by the following formula:

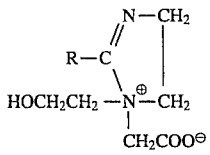

wherein R is as defined above; and amphoteric surfactant (IX)

an amphoteric sulfobetaine surfactant represented by the following formula:

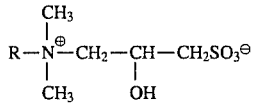

wherein R is as defined above.

3. The superheavy oil emulsion fuel according to claim 1, which further contains 0.01 to 1% by weight of a hydrophilic polymer.

4. The superheavy oil emulsion fuel according to claim 1, which further contains 0.5 to 300 parts by weight, based on 100 parts by weight of an anionic surfactant selected from the group consisting of (XI), (XII), (XIII), XIV), (XV), (XVI), and (XVII):

anionic surfactant (XI)

a sulfonic acid of an alkylphenol or a salt thereof, or a formalin condensate of a sulfonic acid of an aromatic ring compound or a salt thereof, or a formalin condensate of a sulfonic acid of an aromatic ring compound or a salt thereof, wherein the average degree of condensation of formalin is 1.2 to 100 and the salt is an ammonium salt, a lower amine salt such as a monoethanolamine, diethanolamine, triethanolamine or triethylamine salt, or an alkali metal or alkaline earth metal salt such as a sodium, potassium, magnesium or calcium salt;

anionic surfactant (XII)

ligninsulfonic acid, a salt thereof or a derivative thereof, or a formalin condensate of ligninsulfonic acid and a sulfonic acid of an aromatic compound such as naphthalene or alkylnaphthalene, or a salt thereof, wherein the salt is an ammonium salt, a lower amine salt such as monoethanolamine, diethanolamine, triethanolamine or triethylamine salt, or an alkali metal or alkaline earth metal salt such as a sodium, potassium, calcium or magnesium salt and the average degree of condensation of formalin is 1.2 to 50;

anionic surfactant (XIII)

polystyrenesulfonic acid or a salt thereof or a copolymer or styrenesulfonic acid with other comonomer(s) or a salt thereof, wherein the molecular weight is 500 to 500,000 and the salt is an ammonium salt, a lower amine salt such as a monoethanolamine, diethanolamine, triethanolamine or triethylamine salt, or an alkali metal or alkaline earth metal salt such as a sodium, potassium, calcium or magnesium salt;

anionic surfactant (XIV)

a polymer of dicyclopentadienesulfonic acid or a salt thereof, wherein the molecular weight is 500 to 500,000 and the salt is an ammonium salt, a lower amine salt such as a monoethanolamine, diethanolamine, triethanolamine or triethylamine salt, or an alkali metal or alkaline earth metal salt such as a sodium, potassium, calcium or magnesium salt;

anionic surfactant (XV)

a copolymer of maleic anhydride or/and itaconic anhydride with other comonomer(s) or a salt thereof, wherein the molecular weight is 500 to 500,000, and the salt is an ammonium salt or an alkali metal salt such as a sodium or potassium salt;

anionic surfactant (XVI)

a maleinized liquid polybutadiene or a salt thereof, wherein the molecular weight of the liquid polybutadiene as the starting material is 500 to 200,000, and the salt is an ammonium salt or an alkali metal salt such as a sodium or potassium salt; and anionic surfactant (XVII)

an anionic surfactant having in its molecule one or two hydrophilic groups and selected from the group consisting of the following (a) to (h):

(a) a sulfuric ester salt of an alcohol having 4 to 18 carbon atoms, wherein the salt is an ammonium salt, a lower amine salt such as a monoethanolamine, diethanolamine, triethanolamine or triethylamine salt, or an alkali metal or alkaline earth metal salt such as a sodium, potassium, magnesium or calcium salt;

(b) an $C_{4-8}$ alkane-, alkene- or alkylarylsulfonic acid or a salt thereof, wherein the salt is an ammonium salt, a lower amine salt such as a monoethanolamine, diethanolamine, triethanolamine or triethylamine salt, or an alkali metal or alkaline earth metal salt such as a sodium, potassium, magnesium or calcium salt;

(c) a sulfate or phosphate of an adduct of a compound having in its molecule at least one active hydrogen with an alkylene oxide or a salt thereof, wherein the salt is an ammonium, sodium, potassium, magnesium or calcium salt;

(d) a sulfosuccinic acid ester salt of a saturated or unsaturated alcohol having 4 to 22 carbon atoms, wherein the salt is an ammonium, sodium or potassium salt;

(e) an alkyldiphenyletherdisulfonic acid or a salt thereof, wherein the alkyl group has 8 to 18 carbon atoms, and the salt is an ammonium, sodium, potassium, magnesium or calcium salt;

(f) a tall rosin or a salt thereof, or a mixed tall acid comprising a tall rosin and a tall oil fatty acid, or a salt thereof, wherein the salt is an ammonium, sodium or potassium salt;

(g) an $C_{4-8}$ alkane or alkene fatty acid or a salt thereof, wherein the salt is an ammonium, potassium or sodium salt; and (h) an α-sulfo fatty acid ester salt represented by the following general formula:

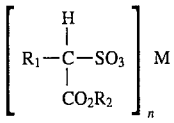

wherein $R_1$ represents an alkyl- or alkenylgroup having 6 to 22 carbon atoms, $R_2$ represents an alkyl group having 1 to 22 carbon atoms, M represents an alkali metal ion, an alkaline earth metal ion, an ammonium ion or an organic amine, and n is 1 or 2.

5. The superheavy oil emulsion fuel according to claim 2, which further contains 0.01 to 1% by weight of a hydrophilic polymer.

6. The superheavy oil emulsion fuel according to claim 3, wherein the hydrophilic polymer is one member selected from the group consisting of the following hydrophilic polymers derived from naturally occuring matter and the following hydrophilic synthetic polymers:

hydrophilic polymers derived from naturally occurring matter (A) hydrophilic polymers derived from microorganisms (polysaccharides):
- (a) xanthan gum,
- (b) pullulan, and
- (c) dextran;

(B) hydrophilic polymers derived from plants (polysaccharides):
- (a) derived from marine algae:
  - (i) agar,
  - (ii) carrageenan,
  - (iii) furcellaran, and
  - (iv) alginic acid and salts (Na, K, $NH_4$, Ca or Mg) thereof,
- (b) derived from seeds:
  - (i) locust bean gum,
  - (ii) guar gum,
  - (iii) tara gum, and
  - (iv) tamarind gum,
- (c) trees (exudates):
  - (i) gum arabic,
  - (ii) gum karaya, and
  - (iii) gum tragacanth,
- (d) derived from fruits:
  - (i) pectin;

(C) hydrophilic polymers derived from animals (proteins):
- (i) gelatin, and
- (ii) casein;

(D) naturally occurring polymer derivatives:
- (i) cellulose derivatives (such as carboxymethylcellulose), and
- (ii) chemically modified starch; and hydrophilic synthetic polymers (a) a homopolymer or copolymer of acrylic acid or a derivative thereof represented by the following formula:

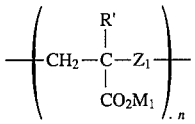

wherein R' represents a hydrogen atom, a methyl group or an ethyl group; $M_1$ represents a hydrogen atom, a sodium ion, a potassium ion, a lithium ion or an ammonium ion; $Z_1$ represents a divalent group derived from a monomer represented by the formula:

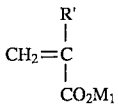

(wherein R' and $M_1$ are as defined above), a comonomer copolymerizable with the monomer or a salt of the comonomer, for example, maleic acid (anhydride), itaconic acid (anhydride), α-olefin, acrylamide, vinylsulfonic acid, allylsulfonic acid, methallylsulfonic acid, acrylamidomethylpropylsulfonic acid or a salt ($NH_4$, Na, K or Li) thereof, a dialkyl(methyl or ethyl)aminoethylmethacrylate or a salt (chloride, diethylsulfate or dimethylsulfate) thereof; and n is 50 to 100,000;

(b) a homopolymer or copolymer of acrylamide or a derivative thereof represented by the following formula:

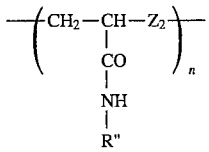

wherein R" represents a hydrogen atom or a $C_2H_4OH$ group; $Z_2$ represents a divalent group derived from a monomer represented by the formula:

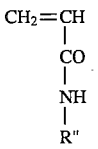

(wherein R" is as defined above), a comonomer copolymerizable with the monomer or a salt of the comonomer, for example, vinylsulfonic acid, allylsulfonic acid, methallylsulfonic acid, acrylamidomethylpropylsulfonic acid or a salt ($NH_4$, Na, K or Li) thereof, a dialkyl(methyl or ethyl)aminoethylmethacrylate or a salt (chloride, dimethylsulfate or diethylsulfate) thereof, styrene, α-olefins ($C_{2-18}$) and vinylallyl alcohol; and n is 50 to 100,000;

(c) a homopolymer of maleic anhydride or itaconic anhydride, or a copolymer thereof represented by the following formula:

wherein $M_2$ represents a maleic anhydride or itaconic anhydride residue; $Z_3$ represents an α-olefin (ethylene, propylene, butylene, isobutylene, octene, decene, dodecene or the like) or styrene residue; and n is 50 to 100,000;

(d) a homopolymer of vinyl alcohol, or a copolymer thereof represented by the following formula:

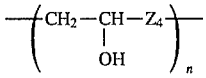

wherein $Z_4$ represents a vinyl acetate or styrene residue; and n' is 30 to 100,000;

(e) a homopolymer of vinylpyrrolidone, or a copolymer thereof represented by the following formula:

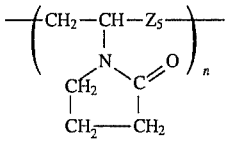

wherein $Z_5$ represents a divalent group derived from a comonomer copolymerizable with vinylpyrrolidone or a salt ($NH_4$, Na, K or Li) thereof, for example, acrylamide, vinylsulfonic acid, methallylsulfonic acid, maleic anhydride, itaconic anhydride or a salt ($NH_4$, Na, K or Li) thereof, styrene, α-olefin ($C_{2-18}$) or the like; and n is 50 to 100,000; and (f) a polyalkylene oxide having a molecular weight of 10,000 to 5,000,000 (wherein the ethylene oxide content is 95% or more and it may contain in its molecule 5% or less of a block polymer of propylene oxide, butylene oxide or styrene oxide, or an alkylaryl or alkyl group).

7. A superheavy oil emulsion fuel comprising, in a mixed and emulsified state, 100 parts by weight of a superheavy oil, 25 to 80 parts by weight of water and 0.02 to 5 parts by weight of a nonionic surfactant selected from the group consisting of the following nonionic surfactants (v), (vi), (vii) and (viii):

nonionic surfactant (v)

a mixture of an (a) alkylene oxide adduct of a tall oil fatty acid, a tall rosin, a gum rosin, a wood rosin or a mixture thereof, and (b) an alkylene oxide polymer;

nonionic surfactant (vi)

a mixture of (a) a mono- or/and diester of a tall oil fatty acid, a tall rosin, a gum rosin, a wood rosin or a mixture thereof with an alkylene oxide polymer, and (b) an alkylene oxide polymer;

nonionic surfactant (vii)

a mixture of (a) an alkylene oxide adduct of an aromatic ring compound having in its molecule one or more carboxyl groups and derived from petroleum or coal, and (b) an alkylene oxide polymer; and nonionic surfactant (viii)

a mixture of (a) a mono- or/and diester of an aromatic ring compound having in its molecule one or more carboxyl groups and derived from petroleum or coal with an alkylene oxide polymer, and (b) an alkylene oxide polymer.

8. A method for regenerating a deteriorated oil-in-water superheavy oil emulsion fuel, which comprises adding 0.01 to 2 parts by weight of a nonionic surfactant selected from the group consisting of the following nonionic surfactants (i), (ii), (iii) and (iv) to 100 parts by weight of an oil-in-water superheavy oil emulsion fuel deteriorated to such a slight extent that the emulsion fuel can be pumped and handled as a fluid liquid, and then subjecting the mixture to high-shear agitation:

nonionic surfactant (i)

an alkylene oxide adduct of a tall oil fatty acid, a tall rosin, a gum rosin, a wood rosin or a mixture thereof;

nonionic surfactant (ii)

a mono- or/and diester of a tall oil fatty acid, a tall rosin, a gum rosin, a wood rosin or a mixture thereof with an alkylene oxide polymer;

nonionic surfactant (iii)

an alkylene oxide adduct of an aromatic ring compound having in its molecule one or more carboxyl groups and derived from petroleum or coal; and nonionic surfactant (iv)

a mono- or/and diester of an aromatic ring compound having in its molecule one or more carboxyl groups and derived from petroleum or coal with an alkylene oxide polymer.

9. A method for regenerating a deteriorated oil-in-water superheavy oil emulsion fuel, which comprises adding 0.01 to 2 parts by weight of a nonionic surfactant selected from the group consisting of the following nonionic surfactants (v), (vi), (vii) and (viii) to 100 parts by weight of an oil-in-water superheavy oil emulsion fuel deteriorated to such a slight extent that the emulsion fuel can be pumped and handled as a fluid liquid, and then subjecting the mixture to high-shear agitation:

nonionic surfactant (v)

a mixture of an (a) alkylene oxide adduct of a tall oil fatty acid, a tall rosin, a gum rosin, a wood rosin or a mixture thereof, and (b) an alkylene oxide polymer;

nonionic surfactant (vi)

a mixture of (a) a mono- or/and diester of a tall oil fatty acid, a tall rosin, a gum rosin, a wood rosin or a mixture thereof with an alkylene oxide polymer, and (b) an alkylene oxide polymer;

nonionic surfactant (vii)

a mixture of an (a) alkylene oxide adduct of an aromatic ring compound having in its molecule one or more carboxyl groups and 00derived from petroleum or coal, and (b) an alkylene oxide polymer; and nonionic surfactant (viii)

a mixture of (a) a mono- or/and diester of an aromatic ring compound having in its molecule one or more carboxyl groups and derived from petroleum or coal with an alkylene oxide polymer, and (b) an alkylene oxide polymer.

10. A method for regenerating a deteriorated oil-in-water superheavy oil emulsion fuel, which comprises adding both an anionic surfactant selected from the group consisting of the following anionic surfactants (XI), (XII), (XIII), (XIV), (XV), (XVI) and (XVII) and a nonionic surfactant selected from the group consisting of the following nonionic surfactants (i), (ii), (iii) and (iv) to an oil-in-water superheavy oil emulsion fuel deteriorated to such a remarkable extent that the emulsion fuel has such a high viscosity that the pumping thereof is difficult and it cannot be handled as a fluid liquid in such a proportion that the weight ratio of the anionic surfactant to the nonionic surfactant is in the range of from 10/1 to 1/10 and the total amount of the anionic surfactant and the nonionic surfactant is 0.01 to 3 parts by weight based on 100 parts by weight of the deteriorated oil-in-water emulsion fuel, and then agitating the resultant mixture:

anionic surfactant (XI)

a sulfonic acid of an aromatic ring compound such as naphthalene, alkylnaphthalene, alkylphenol and alkylbenzene or a salt thereof, or a formalin condensate of a sulfonic acid of an aromatic ring compound or a salt thereof, wherein the average degree of condensation of formalin is 1.2 to 100 and the salt is an ammonium salt, a lower amine salt such as a monoethanolamine, diethanolamine, triethanolamine or triethylamine salt, or an alkali metal or alkaline earth metal salt such as a sodium, potassium, magnesium or calcium salt;

anionic surfactant (XII)

ligninsulfonic acid, a salt thereof or a derivative thereof, or a formalin condensate of ligninsulfonic acid and a sulfonic acid of an aromatic compound such as naphthalene or alkylnaphthalene, or a salt thereof, wherein the salt is an ammonium salt, a lower amine salt such as a monoethanolamine, diethanolamine, triethanolamine or triethylamine salt, or an alkali metal or alkaline earth metal salt such as a sodium, potassium, calcium or magnesium salt and the average degree of condensation of formalin is 1.2 to 50;

anionic surfactant (XIII)

polystyrenesulfonic acid or a salt thereof or a copolymer of styrenesulfonic acid with other comonomer(s) or a salt thereof, wherein the molecular weight is 500 to 500,000 and the salt is an ammonium salt, a lower amine salt such as a monoethanolamine, diethanolamine, triethanolamine or triethylamine salt, or an alkali metal or alkaline earth metal salt such as a sodium, potassium, calcium or magnesium salt;

anionic surfactant (XIV)

a polymer of dicyclopentadienesulfonic acid or a salt thereof, wherein the molecular weight is 500 to 500,000 and the salt is an ammonium salt, a lower amine salt such as a monoethanolamine, diethanolamine, triethanolamine or triethylamine salt, or an alkali metal or alkaline earth metal salt such as a sodium, potassium, calcium or magnesium salt;

anionic surfactant (XV)

a copolymer of maleic anhydride or/and itaconic anhydride with other comonomer(s) or a salt thereof, wherein the molecular weight is 500 to 500,000, and the salt is an ammonium salt or an alkali metal salt such as a sodium or potassium salt;

anionic surfactant (XVI)

a maleinized liquid polybutadiene or a salt thereof, wherein the molecular weight of the liquid polybutadiene as the starting material is 500 to 200,000, and the salt is an ammonium salt or an alkali metal salt such as a sodium or potassium salt; and anionic surfactant (XVII)

an anionic surfactant having in its molecule one or two hydrophilic groups and selected from the group consisting of the followings (a) to (h):

(a) a sulfuric ester salt of an alcohol having 4 to 18 carbon atoms, wherein the salt is an ammonium salt, a lower amine salt such as a monoethanolamine, diethanolamine, triethanolamine or triethylamine salt, or an alkali metal or alkaline earth metal salt such as a sodium, potassium, magnesium or calcium salt;

(b) an $C_{4-18}$ alkane-, alkene- or alkylarylsulfonic acid or a salt thereof, wherein the salt is an ammonium salt, a lower amine salt such as a monoethanolamine, diethanolamine, triethanolamine or triethylamine salt, or an alkali metal or alkaline earth metal salt such as a sodium, potassium, magnesium or calcium salt;

(c) a sulfate or phosphate of an adduct of a compound having in its molecule at least one active hydrogen with an alkylene oxide or a salt thereof, wherein the salt is an ammonium, sodium, potassium, magnesium or calcium salt;

(d) a sulfosuccinic acid ester salt of a saturated or unsaturated alcohol having 4 to 22 carbon atoms, wherein the salt is an ammonium, sodium or potassium salt;

(e) an alkyldiphenyletherdisulfonic acid or a salt thereof, wherein the alkyl group has 8 to 18 carbon atoms, and the salt is an ammonium, sodium, potassium, magnesium or calcium salt;

(f) a tall rosin or a salt thereof, or a mixed tall acid comprising a tall rosin and a tall oil fatty acid, or a salt thereof, wherein the salt is an ammonium, sodium or potassium salt;

(g) an $C_{4-18}$ alkane or alkene fatty acid or a salt thereof, wherein the salt is an ammonium, potassium or sodium salt; and (h) an α-sulfo fatty acid ester salt represented by the following general formula:

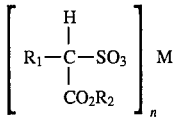

wherein $R_1$ represents an alkyl- or alkenylgroup having 6 to 22 carbon atoms, $R_2$ represents an alkyl group having 1 to 22 carbon atoms, M represents an alkali metal ion, an alkaline earth metal ion, an ammonium ion or an organic amine, and n is 1 or 2;

nonionic surfactant (i)

an alkylene oxide adduct of a tall oil fatty acid, a tall rosin, a gum rosin, a wood rosin or a mixture thereof;

nonionic surfactant (ii)

a mono- or/and diester of a tall oil fatty acid, a tall rosin, a gum rosin, a wood rosin or a mixture thereof with an alkylene oxide polymer;

nonionic surfactant (iii)

an alkylene oxide adduct of an aromatic ring compound having in its molecule one or more carboxyl groups and derived from petroleum or coal; and nonionic surfactant (iv)

a mono- or/and diester of an aromatic ring compound having in its molecule one or more carboxyl groups and derived from petroleum or coal with an alkylene oxide polymer.

11. A method for regenerating a deteriorated oil-in-water superheavy oil emulsion fuel, which comprises adding both an anionic surfactant selected from the group consisting of the following anionic surfactants (XI), (XII), (XIII), (XIV), (XV), (XVI) and (XVII) and a nonionic surfactant selected from the group consisting of the following nonionic surfactants (v), (vi), (vii) and (viii) to an oil-in-water superheavy oil emulsion fuel deteriorated to such a remarkable extent that the emulsion fuel has such a high viscosity that the pumping thereof is difficult and it cannot be handled as a fluid liquid in such a proportion that the weight ratio of the anionic surfactant to the nonionic surfactant is in the range of from 10/1 to 1/10 and the total amount of the anionic surfactant and the nonionic surfactant is 0.01 to 3 parts by weight based on 100 parts by weight of the deteriorated oil-in-water emulsion fuel, and then agitating the resultant mixture:

anionic surfactant (XI)

a sulfonic acid of an aromatic ring compound such as naphthalene, alkylnaphthalene, alkylphenol and alkylbenzene or a salt thereof, or a formalin condensate of a sulfonic acid of an aromatic ring compound or a salt thereof, wherein the average degree of condensation of formalin is 1.2 to 100 and the salt is an ammonium salt, a lower amine salt such as a monoethanolamine, diethanolamine, triethanolamine or triethylamine salt, or an alkali metal or alkaline earth metal salt such as a sodium, potassium, magnesium or calcium salt;

anionic surfactant (XII)

ligninsulfonic acid, a salt thereof or a derivative thereof, or a formalin condensate of ligninsulfonic acid and a sulfonic acid of an aromatic compound such as naphthalene or alkylnaphthalene, or a salt thereof, wherein the salt is an ammonium salt, a lower amine salt such as a monoethanolamine, diethanolamine, triethanolamine or triethylamine salt, or an alkali metal or alkaline earth metal salt such as a sodium, potassium, calcium or magnesium salt and the average degree of condensation of formalin is 1.2 to 50;

anionic surfactant (XIII)

polystyrenesulfonic acid or a salt thereof or a copolymer of styrenesulfonic acid with other comonomer(s) or a salt thereof, wherein the molecular weight is 500 to 500,000 and the salt is an ammonium salt, a lower amine salt such as a monoethanolamine, diethanolamine, triethanolamine or triethylamine salt, or an alkali metal or alkaline earth metal salt such as a sodium, potassium, calcium or magnesium salt;

anionic surfactant (XIV)

a polymer of dicyclopentadienesulfonic acid or a salt thereof, wherein the molecular weight is 500 to 500,000 and the salt is an ammonium salt, a lower amine salt such as a monoethanolamine, diethanolamine, triethanolamine or triethylamine salt, or an alkali metal or alkaline earth metal salt such as a sodium, potassium, calcium or magnesium salt;

anionic surfactant (XV)

a copolymer of maleic anhydride or/and itaconic anhydride with other comonomer(s) or a salt thereof, wherein the molecular weight is 500 to 500,000, and the salt is an ammonium salt or an alkali metal salt such as a sodium or potassium salt;

anionic surfactant (XVI)

a maleinized liquid polybutadiene or a salt thereof, wherein the molecular weight of the liquid polybutadiene as the starting material is 500 to 200,000, and the salt is an ammonium salt or an alkali metal salt such as a sodium or potassium salt; and anionic surfactant (XVII)

an anionic surfactant having in its molecule one or two hydrophilic groups and selected from the group consisting of the followings (a) to (h):

(a) a sulfuric ester salt of an alcohol having 4 to 18 carbon atoms, wherein the salt is an ammonium salt, a lower amine salt such as a monoethanolamine, diethanolamine, triethanolamine or triethylamine salt, or an alkali metal or alkaline earth metal salt such as a sodium, potassium, magnesium or calcium salt;

(b) an $C_{4-18}$ alkane-, alkene- or alkylarylsulfonic acid or a salt thereof, wherein the salt is an ammonium salt, a lower amine salt such as a monoethanolamine, diethanolamine, triethanolamine or triethylamine salt, or an alkali metal or alkaline earth metal salt such as a sodium, potassium, magnesium or calcium salt;

(c) a sulfate or phosphate of an adduct of a compound having in its molecule at least one active hydrogen with an alkylene oxide or a salt thereof, wherein the salt is an ammonium, sodium, potassium, magnesium or calcium salt;

(d) a sulfosuccinic acid ester salt of a saturated or unsaturated alcohol having 4 to 22 carbon atoms, wherein the salt is an ammonium, sodium or potassium salt;

(e) an alkyldiphenyletherdisulfonic acid or a salt thereof, wherein the alkyl group has 8 to 18 carbon atoms, and the salt is an ammonium, sodium, potassium, magnesium or calcium salt;

(f) a tall rosin or a salt thereof, or a mixed tall acid comprising a tall rosin and a tall oil fatty acid, or a salt thereof, wherein the salt is an ammonium, sodium or potassium salt;

(g) an $C_{4-18}$ alkane or alkene fatty acid or a salt thereof, wherein the salt is an ammonium, potassium or sodium salt; and (h) an α-sulfo fatty acid ester salt represented by the following general formula:

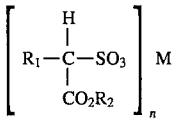

wherein $R_1$ represents an alkyl- or alkenylgroup having 6 to 22 carbon atoms, $R_2$ represents an alkyl group having 1 to 22 carbon atoms, M represents an alkali metal ion, an alkaline earth metal ion, an ammonium ion or an organic amine, and n is 1 or 2;

nonionic surfactant (v)

a mixture of (a) an alkylene oxide adduct of a tall oil fatty acid, a tall rosin, a gum rosin, a wood rosin or a mixture thereof, and (b) an alkylene oxide polymer;

nonionic surfactant (vi)

a mixture of (a) a mono- or/and diester of a tall oil fatty acid, a tall rosin, a gum rosin, a wood rosin or a mixture thereof with an alkylene oxide polymer, and (b) an alkylene oxide polymer;

nonionic surfactant (vii)

a mixture of (a) an alkylene oxide adduct of an aromatic ring compound having in its molecule one or more carboxyl groups and derived from petroleum or coal, and (b) an alkylene oxide polymer; and nonionic surfactant (viii)

a mixture of (a) a mono- or/and diester of an aromatic ring compound having in its molecule one or more carboxyl groups and derived from petroleum or coal with an alkylene oxide polymer, (b) and an alkylene oxide polymer.

12. The superheavy oil emulsion fuel according to claim 4, which further contains 0.01 to 1% by weight of a hydrophilic polymer.

* * * * *